US008141400B2

(12) United States Patent
Sorensen et al.

(10) Patent No.: US 8,141,400 B2
(45) Date of Patent: Mar. 27, 2012

(54) KEYPAD LOCKSET

(75) Inventors: Birk Cliff Sorensen, Whittier, CA (US); Ping Hsien Tsai, Walnut, CA (US); Wai Pang Wong, Orange, CT (US); John Edward Walsh, Wallingford, CT (US); Louis Romo Martinez, Montebello, CA (US)

(73) Assignee: Emtek Products, Inc., City of Industry, CA (US)

( * ) Notice: Subject to any disclaimer, the term of this patent is extended or adjusted under 35 U.S.C. 154(b) by 29 days.

(21) Appl. No.: 12/730,148

(22) Filed: Mar. 23, 2010

(65) Prior Publication Data

US 2010/0257906 A1 Oct. 14, 2010

Related U.S. Application Data

(60) Provisional application No. 61/168,558, filed on Apr. 10, 2009, provisional application No. 61/185,184, filed on Jun. 8, 2009.

(51) Int. Cl.
*E05B 47/00* (2006.01)

(52) U.S. Cl. ..... 70/279.1; 70/277; 70/278.1; 70/278.7; 70/280; 70/281; 70/282; 70/283; 70/468; 70/472; 70/190; 340/5.54; 340/5.64; 340/5.7

(58) Field of Classification Search ..... 70/277, 70/278.1, 278.7, 279.1–283, 468, 472, 190; 340/5.54, 5.64, 5.7
See application file for complete search history.

(56) References Cited

U.S. PATENT DOCUMENTS

| | | | |
|---|---|---|---|
| D208,326 | S | 8/1967 | Sonnenleiter |
| 4,135,377 | A | 1/1979 | Kleefeldt et al. |
| 4,637,237 | A | 1/1987 | Witkoski et al. |
| 4,656,850 | A | 4/1987 | Tabata |
| 4,672,826 | A | 6/1987 | Mombelli |
| 4,675,826 | A | 6/1987 | Gentry et al. |
| 4,770,012 | A | 9/1988 | Johansson et al. |
| 4,802,353 | A | 2/1989 | Corder et al. |
| 4,820,330 | A | 4/1989 | Lin |
| 4,899,562 | A | 2/1990 | Gartner et al. |
| 4,936,122 | A | 6/1990 | Osada |
| 4,995,248 | A | 2/1991 | Liu |

(Continued)

FOREIGN PATENT DOCUMENTS

EP 1457624 A1 * 9/2004

*Primary Examiner* — Suzanne Barrett
*Assistant Examiner* — David E Sosnowski
(74) *Attorney, Agent, or Firm* — Lewis Brisbois Bisgard & Smith LLP; Jon E. Hokanson

(57) ABSTRACT

A keypad lockset adapted for deadbolt as well as lever locks, and having as a first embodiment an exterior gear train, an interior gear train, and an electronically controlled clutch for coupling the gear trains when engaged and for uncoupling the gear trains when the clutch is disengaged, so that when the clutch is engaged rotation of an external thumb turn will permit the door latch to be withdrawn and thus to permit opening of the door, and a mechanical override mechanism that can be operated in case of electrical failure, and in which clutch mechanism and the override mechanism both operate through the single, standard 2 and ⅛ inch door preparation hole, or alternatively as a second embodiment, a keypad lockset in which two four-bar mechanical linkages are used in place of gears as means to actuate the clutch, and alternatively to provide for a pass-through override function.

12 Claims, 25 Drawing Sheets

U.S. PATENT DOCUMENTS 5,027,629 A 7/1991 Liu
5,044,183 A 9/1991 Neyret
D324,477 S 3/1992 Fleming et al.
5,113,675 A 5/1992 Uyeda
D362,173 S 9/1995 Skitromo
5,475,996 A 12/1995 Chen
D365,976 S 1/1996 Chiu
D372,854 S 8/1996 Jimenez
5,611,582 A 3/1997 Frolov et al.
5,640,863 A 6/1997 Frolov
D388,308 S 12/1997 Evans et al.
D396,798 S 8/1998 Adelmeyer et al.
5,841,361 A 11/1998 Hoffman
5,920,268 A * 7/1999 Bucci et al. ..... 340/5.64
5,923,264 A 7/1999 Lavelle et al.
5,923,942 A 7/1999 Nuggehalli et al.
5,992,195 A 11/1999 Huang et al.
6,104,594 A 8/2000 Frolov et al.
D433,920 S 11/2000 Chang
6,286,347 B1 9/2001 Frolov
D452,640 S 1/2002 Gartner
D452,952 S 1/2002 Teskey
6,354,121 B1 3/2002 Frolov
D456,689 S 5/2002 Nakamaru
6,386,597 B1 5/2002 Walsh, III
D470,033 S 2/2003 Fleury et al.
D474,103 S 5/2003 Kaiser et al.
6,565,130 B1 5/2003 Walsh, III
6,568,231 B1 5/2003 Huang
D479,682 S 9/2003 Frolov et al.
6,644,077 B1 11/2003 Huang
6,647,753 B2 11/2003 Engler
6,651,468 B2 11/2003 Aramburu et al.
6,714,118 B1 3/2004 Frolov et al.
6,758,070 B2 * 7/2004 Yu et al. ..... 70/277
D495,578 S 9/2004 Sampson et al.
D495,943 S 9/2004 Hentschel et al.
D496,578 S 9/2004 Gotou et al.
6,837,081 B2 1/2005 Ruano Aramburu et al.
6,851,291 B2 2/2005 Nunez
D502,859 S 3/2005 Peng et al.
6,869,116 B2 3/2005 Dalsing
6,895,791 B2 5/2005 Alexander et al.
6,935,149 B1 8/2005 Peng et al.
6,978,646 B2 12/2005 Raatikainen
7,007,524 B2 * 3/2006 Jasper ..... 70/283
7,007,526 B2 3/2006 Frolov et al.
7,069,755 B2 7/2006 Lies et al.
7,091,429 B2 8/2006 Case et al.
7,096,697 B2 8/2006 Keightly
7,096,698 B2 8/2006 Walsh, III et al.
D545,172 S 6/2007 Kaiser et al.
D545,662 S 7/2007 Lu
D545,666 S 7/2007 Manton
D552,964 S 10/2007 Bogdanov et al.
D553,953 S 10/2007 Roberts et al.
7,275,402 B2 10/2007 Lüling et al.
7,308,810 B2 12/2007 Menta San Miguel
RE40,193 E 4/2008 Boehlow
7,516,633 B1 * 4/2009 Chang ..... 70/279.1
7,770,423 B2 * 8/2010 Wu ..... 70/279.1
7,827,837 B2 * 11/2010 Huang et al. ..... 70/279.1
2001/0010166 A1 8/2001 Doucet et al.
2003/0209043 A1 * 11/2003 Yeh et al. ..... 70/280
2007/0157684 A1 7/2007 Bogdanov et al.
2007/0169525 A1 * 7/2007 Chang ..... 70/472

* cited by examiner

KEYPAD LOCKSET

CROSS REFERENCE TO RELATED APPLICATION

This application is a utility patent application based on, incorporates by reference and claims the benefit of priority of U.S. provisional patent application 61/168,558, filed Apr. 10, 2009, and U.S. provisional patent application 61/185,184, filed Jun. 8, 2009, both of which are incorporated by reference.

FIELD OF INVENTION

The invention relates generally to electromechanical door locks, and more particularly to electromechanical door locks having an electronically controlled clutch mechanism and a mechanical override mechanism.

BACKGROUND OF INVENTION

Keypad locks are becoming widely accepted in the residential market. However, many of the locks currently in the market are too large to fit with storm doors or are too bulky to provide good aesthetic appeal. A further barrier to customer acceptance occurs in designs that require additional holes to be drilled into a door in addition to the standard residential bored door prep. These deficiencies deter customers from upgrading their traditional mechanical locks to digital keypad locks. Therefore a need exists for a keypad lock that overcomes theses known installation problems.

Additional problems associated with electronic locks derive from different and conflicting goals for various parts of the lock. For example, the height of a keypad lock cannot be so high that it can no longer fit the space between the main door and the storm door. A lock suffers cosmetically as this height grows; low profile locks are more readily accepted and desired than relatively high profile locks. This preference for low profile locks is in direct conflict with a goal of allowing a standard key cylinder to provide a mechanical override means for the consumer to gain entry when the electronic functions of the lock are not available or desired. The conflict is also related to the relatively long length of standard key cylinders in relation to a typically desired low profile lock thickness or height. Often the cylinder is more than two times as long as the desired lock thickness.

This conflict is further exacerbated by a need or goal of having no new holes in the door in addition to the standard residential door prep. The space under the relatively shallow thickness of the escutcheon and in the 2-⅛ inch diameter hole are the only spaces that can accommodate the lock components such as the cylinder, latch bolt, transmission parts, clutch parts, keypad, PCB, battery, passage mode switch and others.

A digital keypad lock incorporates several mechanisms and has three main components. The first component is a mechanical transmission that functions to transfer the input torque generated by rotating knobs or levers on either side of the door to the bolt or bolt latch that secures the door. Second, an electro-mechanical clutch mechanism is used to engage and disengage the transmission system so that input torque is allowed to be transmitted to the bolt latch only at the appropriate time. The third component of the digital keypad lock is an electronic programmable controller that receives input signals from the keypad or other known input devices. It performs credential checking and initiates commands to activate the electromechanical clutching in response to an authorized credential being presented.

The electro-mechanical clutch mechanism typically includes a directly actuated locking member or a clutch mechanism that connects and disconnects an exterior thumb turn or an exterior handle. The clutch mechanism also typically includes a movable member that releasably couples with the thumb turn or exterior handle, and an electronic actuator that controllably displaces the movable member in response to control signals from the electronic programmable controller. The clutch mechanism typically operates in response to an authorized input, such as a code entered in a keypad or by a swipe card. The authorized input is typically received by the controller, which then generates and transmits a control signal to the actuator that in turn operates the movable clutch member.

The transmission of input motion from the thumb turn or lever to cause the desired effect upon the door securing bolt is performed through the coordination of all the moving parts in the system. All these parts must be synchronized in motion throughout the entire operation cycle, from the time the input thumb turn or lever is activated until the time all of the components return back to their home position. Non-synchronization in any one of the moving parts may cause the lock to not function as intended.

For keypad locks utilizing levers a pre-defined, at-rest orientation for each thumb turn or lever is typically included, and with a horizontal orientation. When the levers sag or otherwise are out of adjustment, the transmission will cause the clutch elements to become misaligned. In this case when a valid code is presented to the controller and the electromechanical clutch is commanded to engage, the latch will fail to respond to the turning of the lever because the clutching elements were not in alignment and ready to receive their respective engaging surfaces. This problem can hinder the locking and unlocking functions, as well as cause security and safety concerns for users.

Such door locks also typically include a mechanical override mechanism that is intended to be used when power is lost to the controller, or when the controller or other electronic component malfunctions. Examples of such conventional electromechanical door locks are described in United States Patent Publication 2007/0157684 entitled "Manual Override Mechanism for Electromechanical Locks".

SUMMARY OF THE INVENTION

The locks described herein address the above mentioned problems by providing cosmetically desirable, low profile keypad locks that can be installed in a standard, residential door having a standard door preparation, without any additional holes and are compatible with storm doors.

The locks described herein provide both relatively low profile cosmetic and functional traits while preserving the ability to use standard lock cylinders and door preparation.

A further benefit of the locks described herein are structures that permit coordination of the clutch so that both sides of the engaging elements are always prepared for positive engagement despite form, fit and function problems nearly always present in mechanical systems due to tolerance, clearance and other inaccuracies.

In accordance with the above, several preferred embodiments of electromechanical locks or locksets as described. They incorporate structures and functions that overcome the drawbacks of known locksets and override mechanisms. A first embodiment is a deadbolt type of lock, having a thumb turn and a clutch mechanism that includes two gear trains, one of which is coupled to the outside lever or turn and input side of the clutch and one of which is coupled to the inside lever, latch or bolt, and output side of the clutch. A second embodiment is a lever type of lock, having a lever and a clutch mechanism that includes two four-bar linkages, one of which is coupled to the outside lever or turn and input side of the clutch and one of which is coupled to the inside lever, latch or bolt, and output side of the clutch. Other embodiments are variations of the dead bolt and lever embodiments.

The preferred clutch mechanism used in the lever embodiment is adapted to engage and disengage the connection between the input axis and the output axis. A cantilever wire spring mechanism provides for engagement through the activation of the motor that drives a preferably square piston pin. The alignment of one side of the clutch to the other side of the clutch is provided by springs that bias the clutch components in their home positions so that they are accurately and precisely positioned for smooth engagement of the piston pin with the transfer hub pocket upon actuation. The preferred present clutch transfer hub system permits accurate and reliable engagement.

In the preferred lever embodiment clutch mechanism, a piston pin with a square or rectangular cross section, which is driven by a motor, is pushed into the clutch transfer hub to engage the connection of the motion. Furthermore, for lever lock type locks that have a pre-defined initial position, the mating recess in the transfer hub to which the piston pin engages has an enhanced geometry, that is, a geometry that allows for a slight angular offset of +/−4 degrees that permits engagement but with some allowance for misalignment. The preferred transfer hub has a diagonal interface engagement with the piston pin instead of an edge-to-edge face interface. A further enhancement is the use of the pin with a rectangular cross section which will allow only a single defined relationship for the engagement when considered against the range of rotation possible with the lever input. This technique prevents a false relationship of engagement that could occur with a square or other polygon where the clutch could couple the lever to the latch at the end of the lever stroke which would not allow the latch to then operate as expected and could damage the lock.

When considering lever type locks whose inputs customarily have a defined at rest position, usually horizontal, it is necessary to take steps to positively align the parts on both sides of the clutch interface to allow for the immediate engagement of the clutch and subsequent retraction of the latch as the lever is depressed. This concern is diminished in products that use a turn because there is not a pre-defined limitation to the arc of rotation; rather, the turn may free spin and once the clutch is engaged may continue to turn until the bolt is acted upon. When considering lever type locks or locks that have an inherent limitation to the degree of rotation allowed, in order to avoid an irregular or misaligned return position of the parts after retraction, and also due to parts tolerance stack-up, a torsion spring holds the clutch parts under tension, thus allowing accurate and repeatable positioning at the home position after operation of the lock. The torsion spring resides in the outer housing and functions to bias the clutch parts in the outside housing to the defined home position. This spring helps to guide these components so that they align accurately and consistently every time the parts return home after operation of the lock. This technique is not needed for free spinning inputs such as those that could be used on dead bolt type locks that use a turn input.

The first or dead bolt embodiment keypad lockset has an exterior gear train, an interior gear train, and an electronically controlled clutch for coupling the gear trains when engaged and for uncoupling the gear trains when the clutch is disengaged. When the clutch is engaged, rotation of an external thumb turn will permit the door latch bolt to be withdrawn and thus permit opening of the door. A mechanical override mechanism is included in the lockset, and the override is intended to be operated in case of electrical failure. In addition, the clutch mechanism and the override mechanism both operate through the single standard 2 and ⅛ inch door preparation hole or bore.

The second or lever embodiment keypad lockset has an exterior four-bar mechanism, an interior four-bar mechanism, and an electronically controlled clutch for coupling the four-bar mechanisms when engaged and for uncoupling the four-bar mechanisms when the clutch is disengaged. When the clutch is engaged, rotation of an external lever will permit the door dead latch to be withdrawn and thus permit opening of the door. A mechanical override mechanism is included in the lockset, and the override is intended to be operated in case of electrical failure or user preference. In addition, the clutch mechanism and the override mechanism both operate through the single, standard 2 and ⅛ inch door preparation hole or bore.

These and other embodiments, features, aspects, and advantages of the invention will become better understood with regard to the following description, appended claims and accompanying drawings.

BRIEF DESCRIPTION OF THE DRAWINGS

The foregoing aspects and the attendant advantages of the present invention will become more readily appreciated by reference to the following detailed description, when taken in conjunction with the accompanying drawings, wherein.

Reference symbols or names are used in the Figures to indicate certain components, aspects or features shown therein. Reference symbols common to more than one Figure indicate like components, aspects or features shown therein.

DETAILED DESCRIPTION

For convenience in describing the components, sub-assemblies, the fully assembled keypad lockset embodiments and their spatial and functional relationships, each to the other, the terms vertical or height as used herein refers to the direction from the bottom to the top, or vice versa of a door as it is normally found installed in a building, that is, along the z axis as shown in various figures. The term depth refers to the direction from the outside to the inside, or vice versa of a door as it is normally found installed in a building, that is, along the x axis as shown in various figures. The term width refers to the direction from left to right, or vice versa as a person is facing a door is it is normally found installed and shut in a building, that is, along the y axis as shown in various figures. The terms exterior, outside or external refer to the side of the door on which the keypad is positioned, and the terms interior, internal, inside or inner refer to the other side of the door.

First Preferred Embodiment, Deadbolt Keypad Lockset

Figure 1:
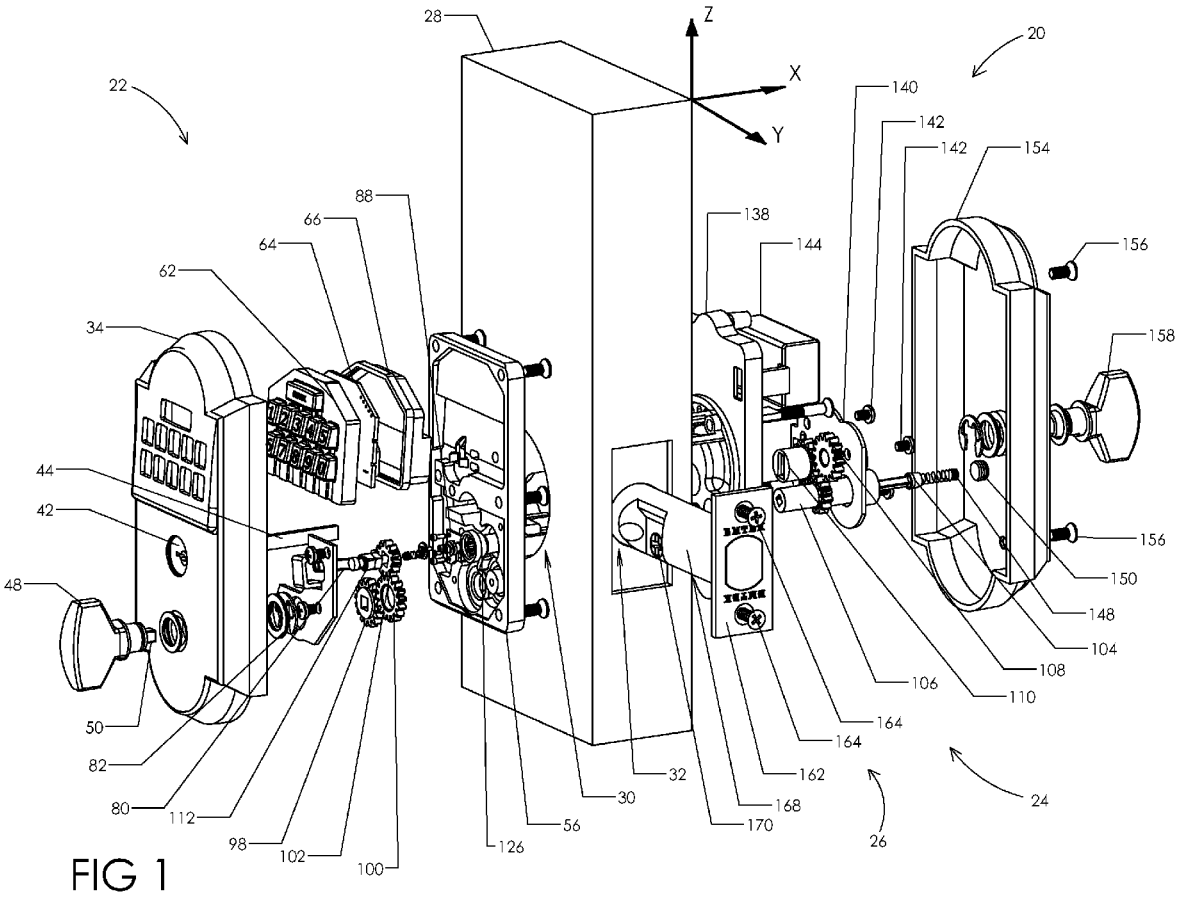
FIG. 1 is an exploded view of a first, dead bolt preferred embodiment keypad lockset.

In accordance with FIGS. 1-11 a preferred first, deadbolt embodiment keypad lockset 20 will be described. The lockset 20 as shown in FIG. 1 is a deadbolt keypad lockset having an exterior or outside sub-assembly 22, an interior or inside sub-assembly 24 and a latch sub-assembly 26. Lockset 20 is adapted for use with a standard preparation for a door 28, including a conventional 2 and ⅛ inch diameter hole or bore, the location of which is indicated by arrow 30, through the door along the x axis and a 1 inch diameter hole, the location of which is indicated by arrow 32, through the door 28 along the y axis from the outside edge of the door to the hole or bore 30.

Exterior or Outer Sub-Assembly

Figure 2:
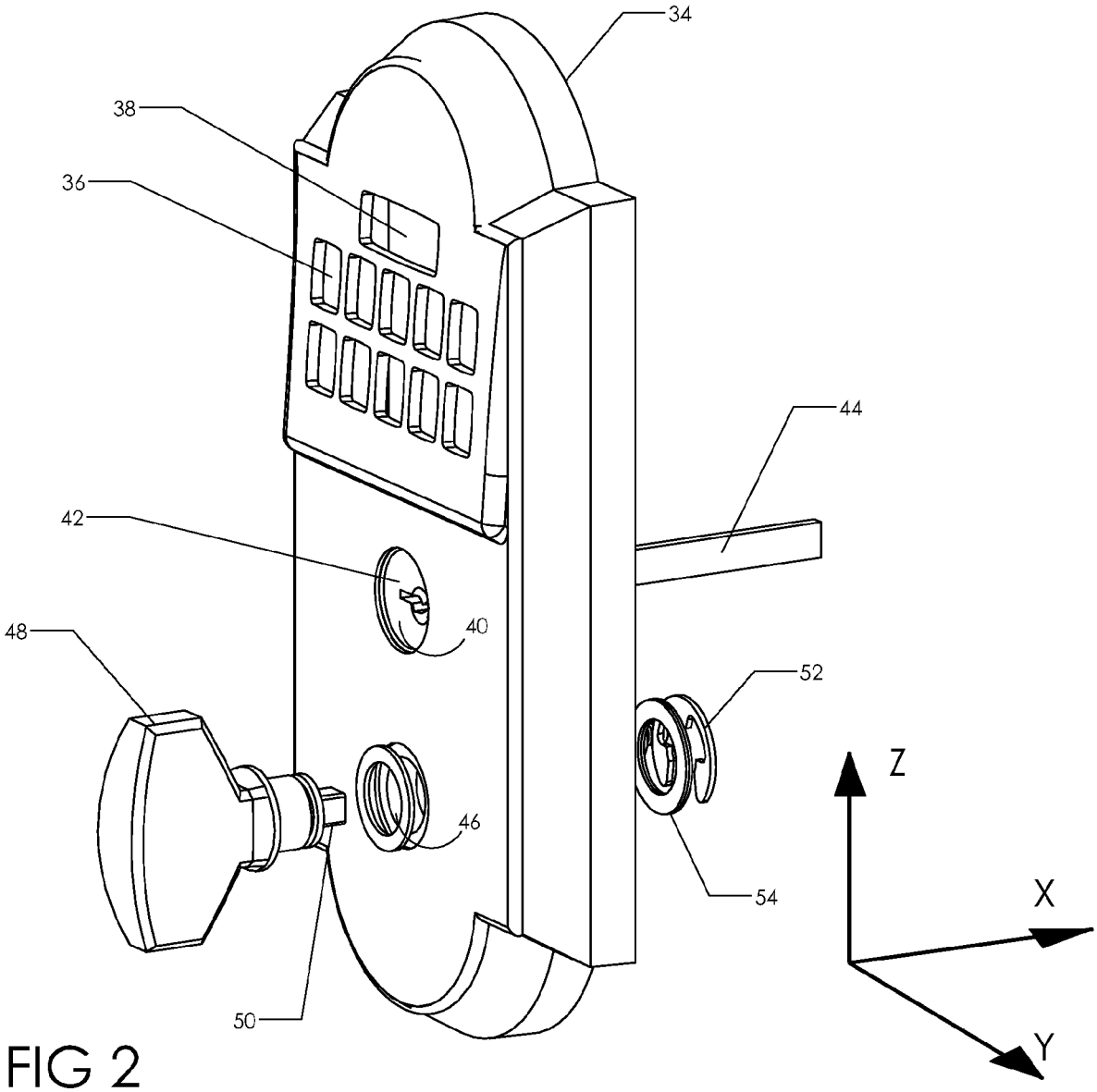
FIG. 2 is a front elevational view of the exterior plate and thumb turn of the FIG. 1 embodiment.

Referring to FIG. 2 the exterior escutcheon plate 34 includes a 5 by 2 array of holes to accommodate keys for the electronic control system, one of which is shown at 36. As will be appreciated a different number of holes and different configurations for the keys and escutcheon plate are well within the ordinary skill of the art in this field. Plate 34 also includes rectangular hole 38 for a product identifier or another key for operation of the control system, or for another indicator, such as an indicator of the status of the electronic control system of the lockset. Hole 40 is sized and positioned to accommodate a conventional cylinder 42, out of which tailpiece 44 extends along the x axis to operate the override mechanism. Hole 46 is sized and positioned to accommodate thumb turn 48 and associated components including spindle 50 and clip 52 and washer 54 to retain the thumb turn 48.

Figure 3:
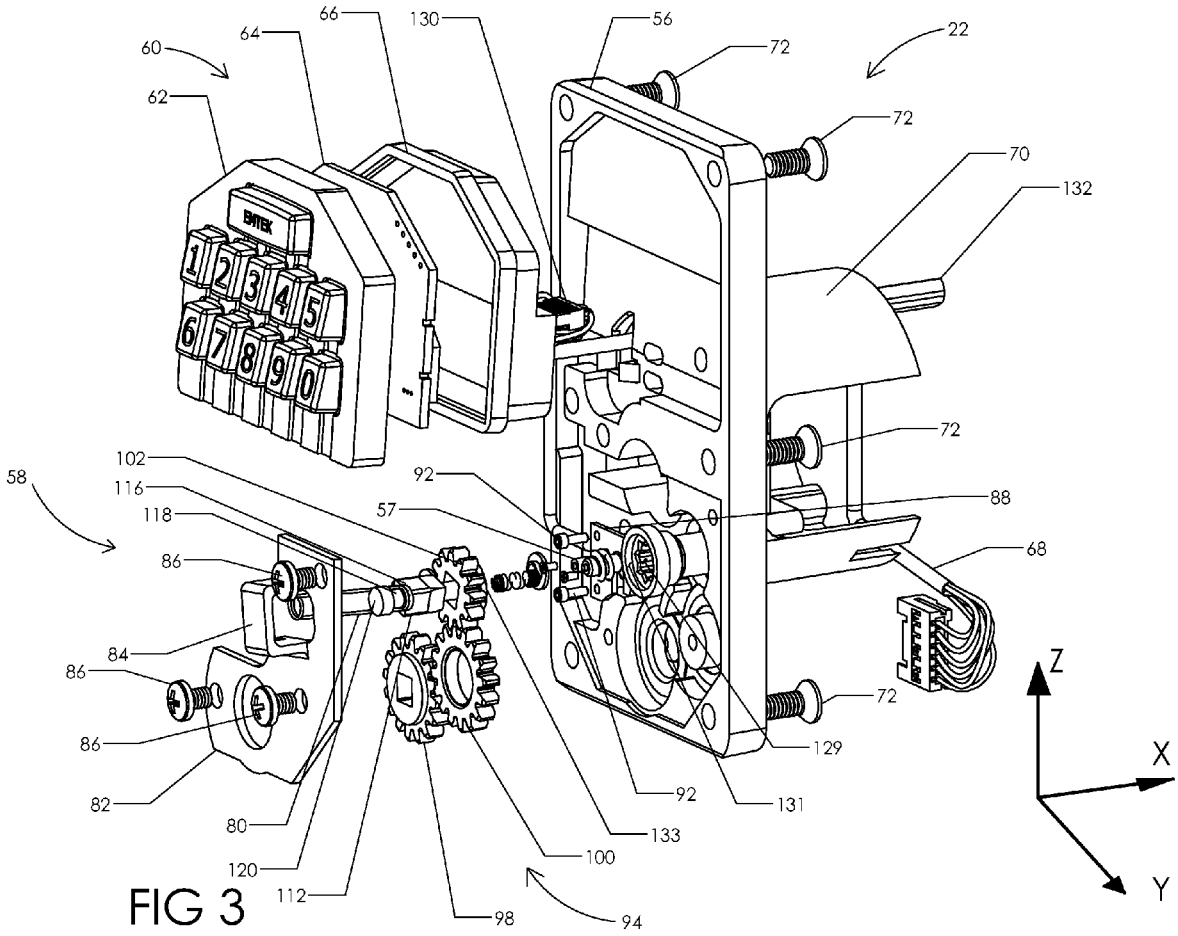
FIG. 3 is an enlarged exploded view of portions of the exterior sub-assembly of the FIG. 1 embodiment.

Referring to FIGS. 3-7 exterior sub-assembly 22 will be described in further detail. Exterior housing 56 is preferably a zinc die cast and functions as the support or base for the exterior clutch mechanism or sub-assembly 58 and for conventional electronic control sub-assembly 60. Sub-assembly 60 includes rubber keypad 62, circuit board 64, circuit board housing or tub 66 and harness 68, shown in part in FIG. 3. Housing 56 includes an internally extending alignment flange or shroud 70. Shroud 70 is preferably integral with the housing 56 and functions to align the exterior sub-assembly with the door 28 for proper mating with the interior housing sub-assembly 24. Exterior housing 56 is preferably fastened to external escutcheon plate, 34 with six screws 72, four of which are shown in FIG. 3. Exterior clutch sub-assembly 58 will be further described with reference to FIGS. 4-7.

Figure 4:
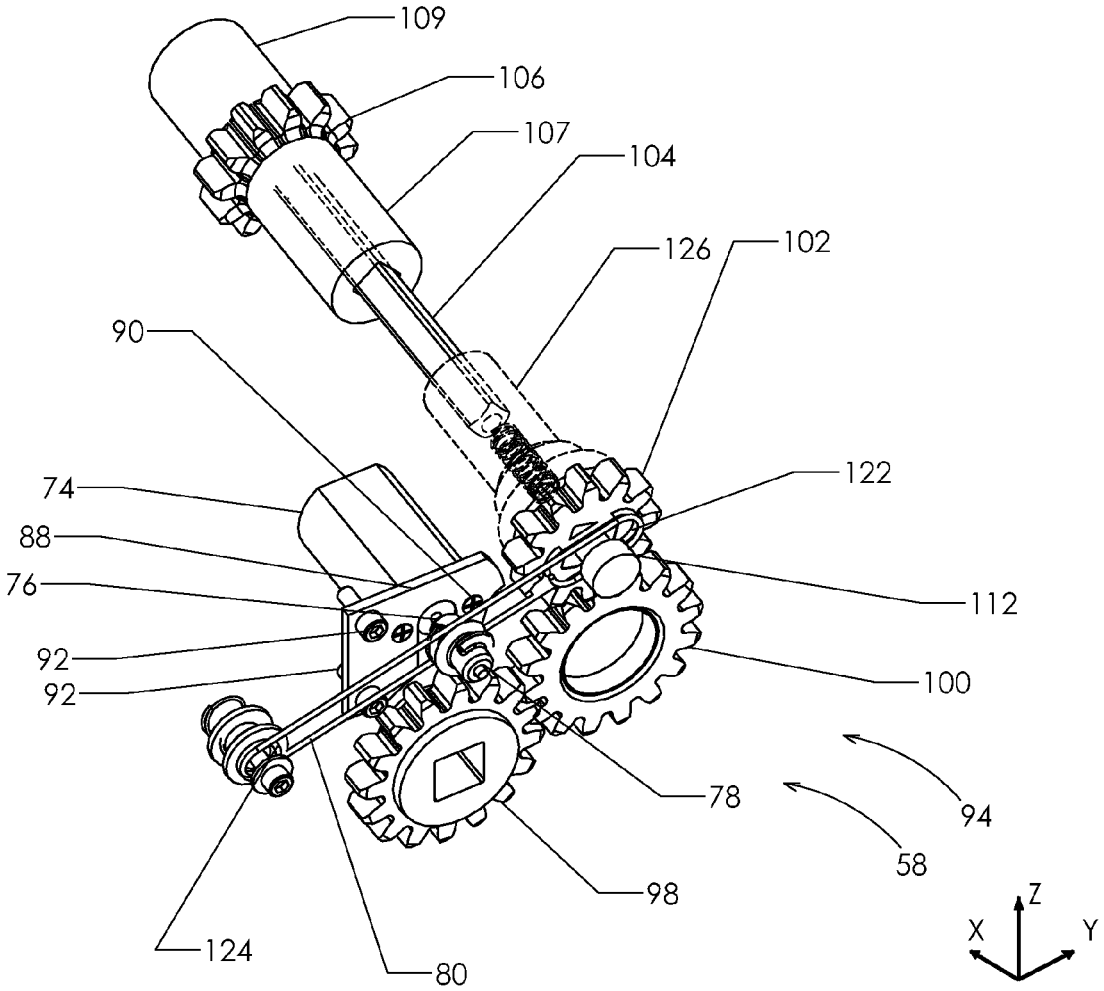
FIG. 4 is an enlarged view of the clutch sub-assembly exterior gear train of the FIG. 1 embodiment.
Figure 5:
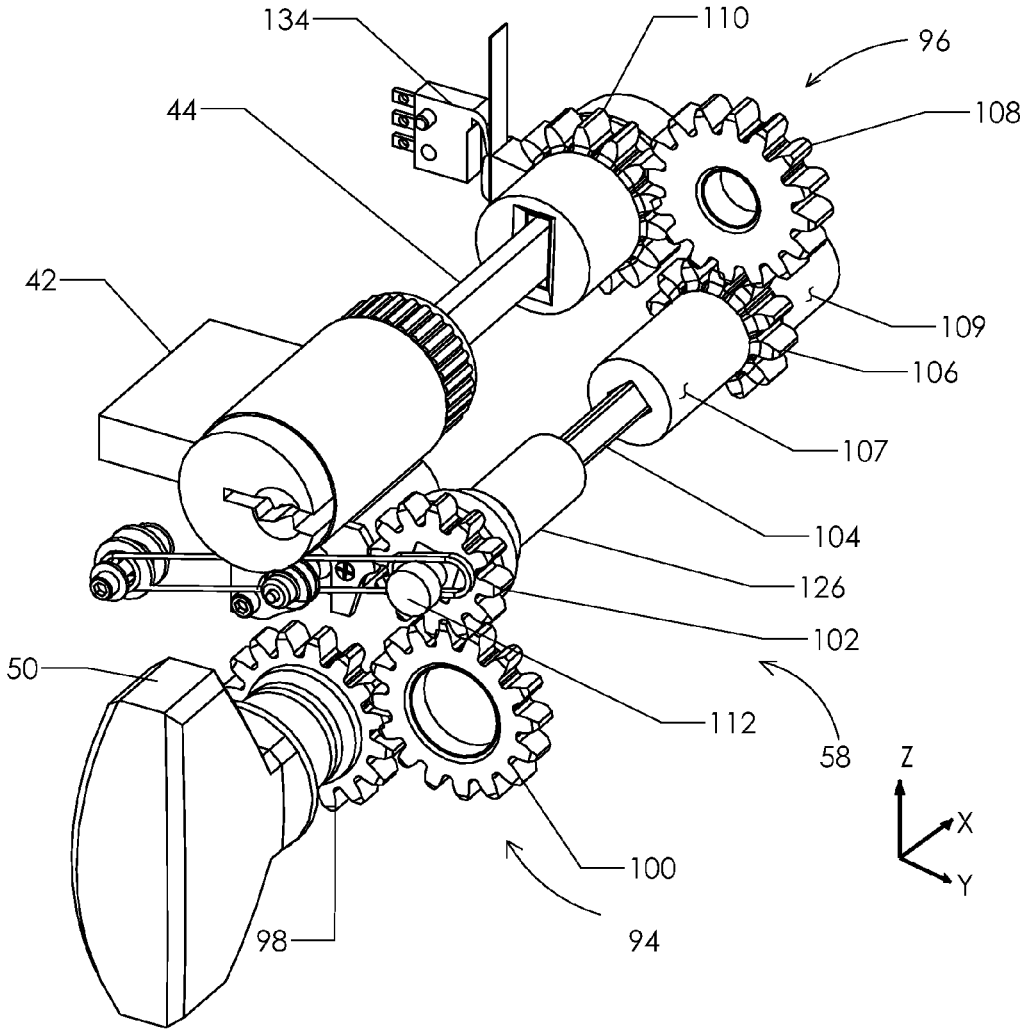
FIG. 5 is an enlarged view of the exterior sub-assembly gear train and the interior sub-assembly gear train of the FIG. 1 embodiment.
Figure 7:
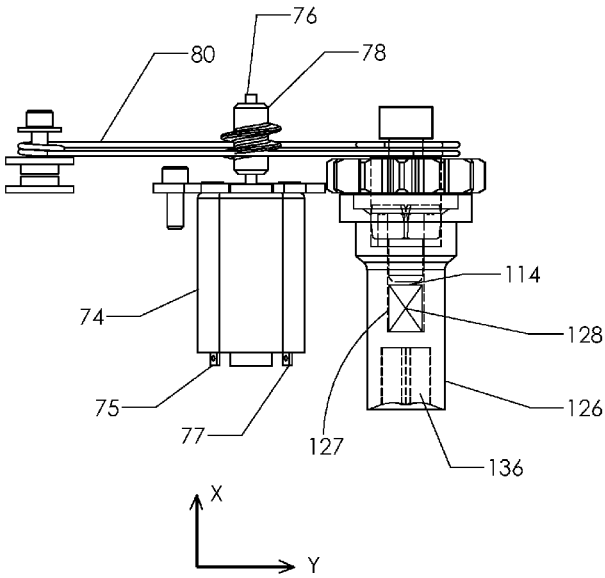
FIG. 7 is a top view of the FIG. 6 motor coupled to the exterior sub-assembly gear train of the FIG. 1 embodiment in a clutch engaged position.
Figure 6:
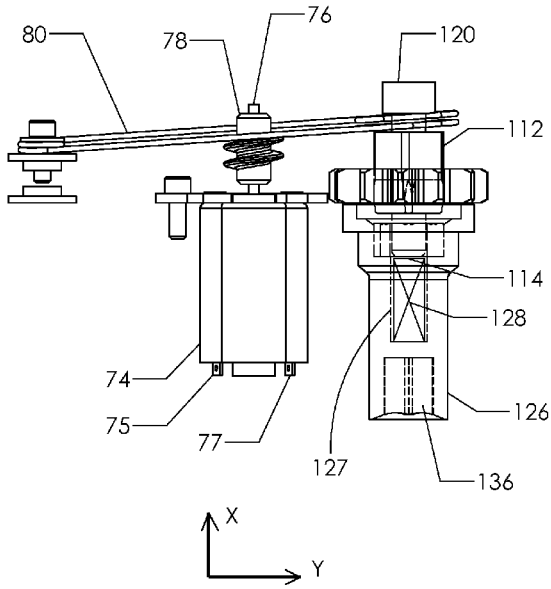
FIG. 6 is a top view of a motor coupled to the exterior sub-assembly gear train of the FIG. 1 embodiment in a clutch disengaged position.

Shown in FIG. 4 the clutch sub-assembly 58 is preferably actuated by motor 74, preferably a DC motor, which includes axle 76, to which a worm drive, or worm gear 78 is preferably permanently attached, as shown in FIGS. 3-7. The motor 74 will rotate the axle 76 and worm drive gear 78 in a first direction to drive hairpin actuator or spring or spring actuator 80 along the x axis in a direction toward the interior sub-assembly. This causes the clutch to be engaged as shown in FIG. 7. The motor 74 can also rotate in the opposite or second direction to rotate the axle 76 and worm drive gear 78 in the second direction to drive hairpin actuator 80 along the x axis in the opposite direction and this will cause the clutch to be disengaged, as shown in FIG. 6.

Again referring to FIGS. 3-5 the clutch sub-assembly 58 includes exterior gear cover 82 which not only covers the exterior gears but also includes stop member 84 that functions as a stop for travel along the x-axis of the actuator 112 during the disengagement operation to prevent overextension of actuator 112. Cover 82 is fastened to exterior housing 56 with three screws 86 as shown in FIG. 3. Motor 74 is mounted to motor mount plate 88 with two screws at 90 shown in FIG. 4. The motor mount plate 88 is mounted to the housing 56 with two screws 92 shown in FIGS. 3 and 4.

With reference to FIGS. 4-7 exterior gear train 94 and interior gear train 96 will be described. The preferred exterior gear train 94 includes thumb turn spindle 50, first exterior gear 98, second exterior gear 100, third exterior gear 102 and clutch axle 104. The interior gear train 96 includes first interior gear 106, second interior gear 108 and third interior gear 110. When the exterior gear train 94 is connected to the interior gear train 96 and when thumb turn spindle 50 is rotated, the third interior gear 110 rotates through this connection.

Referring to FIGS. 3-4 piston 112 preferably includes a distal end 114, central gear-engaging portion 116, shown as having a square-cross section, and the opposite end of the piston with groove portion 118, adjacent to the relatively large diameter head 120. The square cross-sectioned portion 116 is retained in the gear 102 by a complimentary central square retaining hole (not numbered). Hairpin actuator 80 is a spring wire, preferably made of music wire that is formed into the shape shown in FIG. 4. At its first distal end the actuator is formed into an obround slot 122 that rides on the groove portion 118 and is captured between the square portion 116 and head 120. At the opposite distal end 124 the actuator 80 is formed into a loop or circle, with preferably at least one full loop. The end 124 is movably anchored to the exterior housing 56 at a threaded post member 57 that is integral with exterior housing 56, the location of which is shown in FIG. 3. The central part of actuator 80 is sized, aligned and positioned to be driven by the helix of the worm drive gear 78, as shown in FIG. 4.

As shown in FIGS. 4-7 the structures that couple the exterior gear train 94 to the interior gear train 96 will be described. Transfer hub 126 is preferably a metal, cylindrical member that is rotatably positioned in the exterior housing 56 and extends along the x axis. As shown in FIGS. 4, 6 and 7 the hub 126 has a central cavity 127 to accommodate the distal end 114 of the piston and conventional compression spring 128. Hub 126 also has a multifaceted or keyed socket region 129 positioned at its end adjacent the gear 102, with the socket region sized and keyed to accommodate and mate with the interior end of the square cross section portion 116 when the clutch is engaged. Hub 126 also has a distal, relatively large diameter counter bore 131 that surrounds a corresponding projecting shoulder 133 on gears 102 such that gear 102 and hub 126 can rotate independently of each other when the clutch is disengaged.

Also with reference to FIGS. 4-7 an advantageous spring loading function will be described. In the event the piston 112 fails to engage in the transfer hub 126, the actuator 80, by virtue of its being a spring, will bias the piston 112 toward the transfer hub 126 and any slight rotation, such as for example rotation of the thumb turn 48 by a user, will enable the spring force from actuator 80 to force the piston 112 into the socket 129 of the hub 126 as soon as proper alignment is gained and to thus place the lockset into the engaged position.

With reference to FIGS. 1, 3, 5 and 9 a portion of the wire harness 68 that provides for electrical communication between the conventional electronic control system, motor 74, a battery power supply 144 and a switch 134, shown in FIG. 5 that provides a signal to indicate the position of the latch bolt. Connector 130 is located at the upstream end of the harness 68 and connects to the output of the electronic control system at circuit board 64. The portion of the harness in the exterior sub-assembly and shown in FIG. 3 is fed through the tub 66 and through the exterior housing 56, following the plastic guide 132 as shown FIG. 3, and then to the motor 74.

Interior or Inner Sub-Assembly

With reference to FIG. 5 the interior gear train 96 and its coupling to the exterior gear train 94 will be described. Transfer hub 126 includes a cavity 136, shown in FIGS. 6 and 7, into which clutch axle 104 is inserted at its exterior distal end. The opposite distal end of the clutch axle 104 is inserted into interior axle gear 106. Axle gear 106 preferably includes hub extensions 107, 109 that extend out from the gear itself and on both sides along the x axis.

Figure 8:
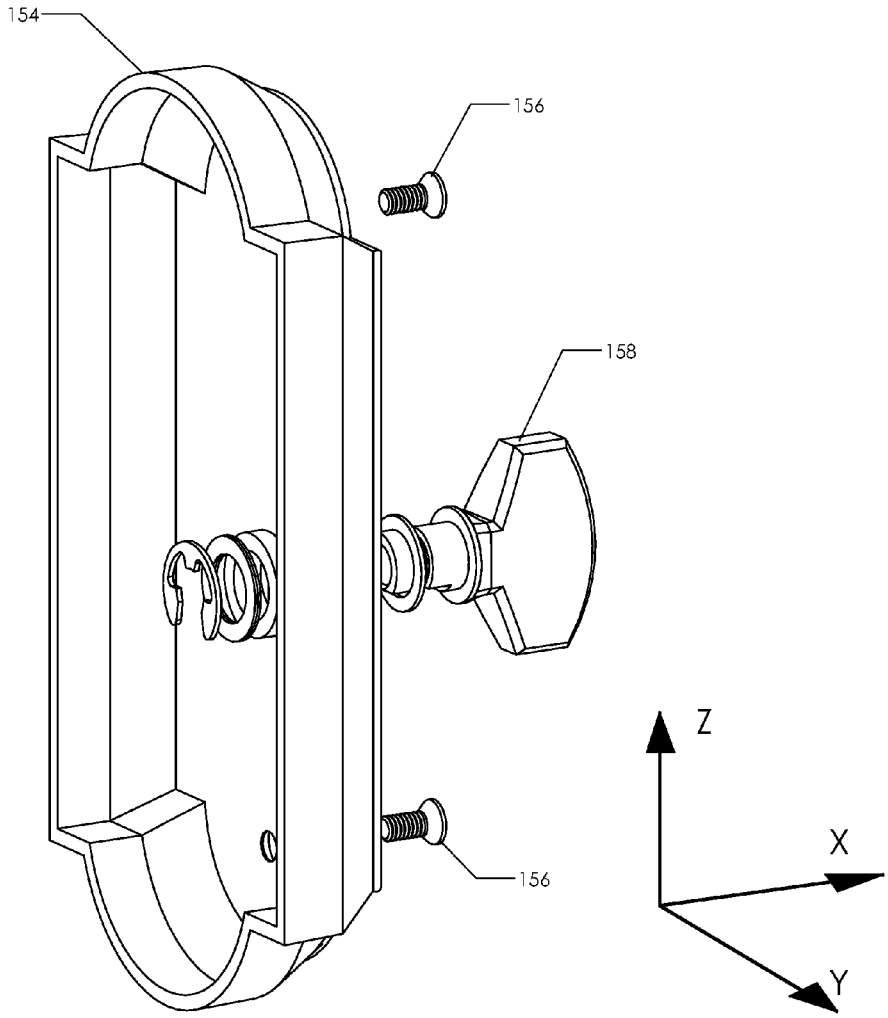
FIG. 8 is a rear elevational view of the interior plate and thumb turn of the FIG. 1 embodiment.
Figure 9:
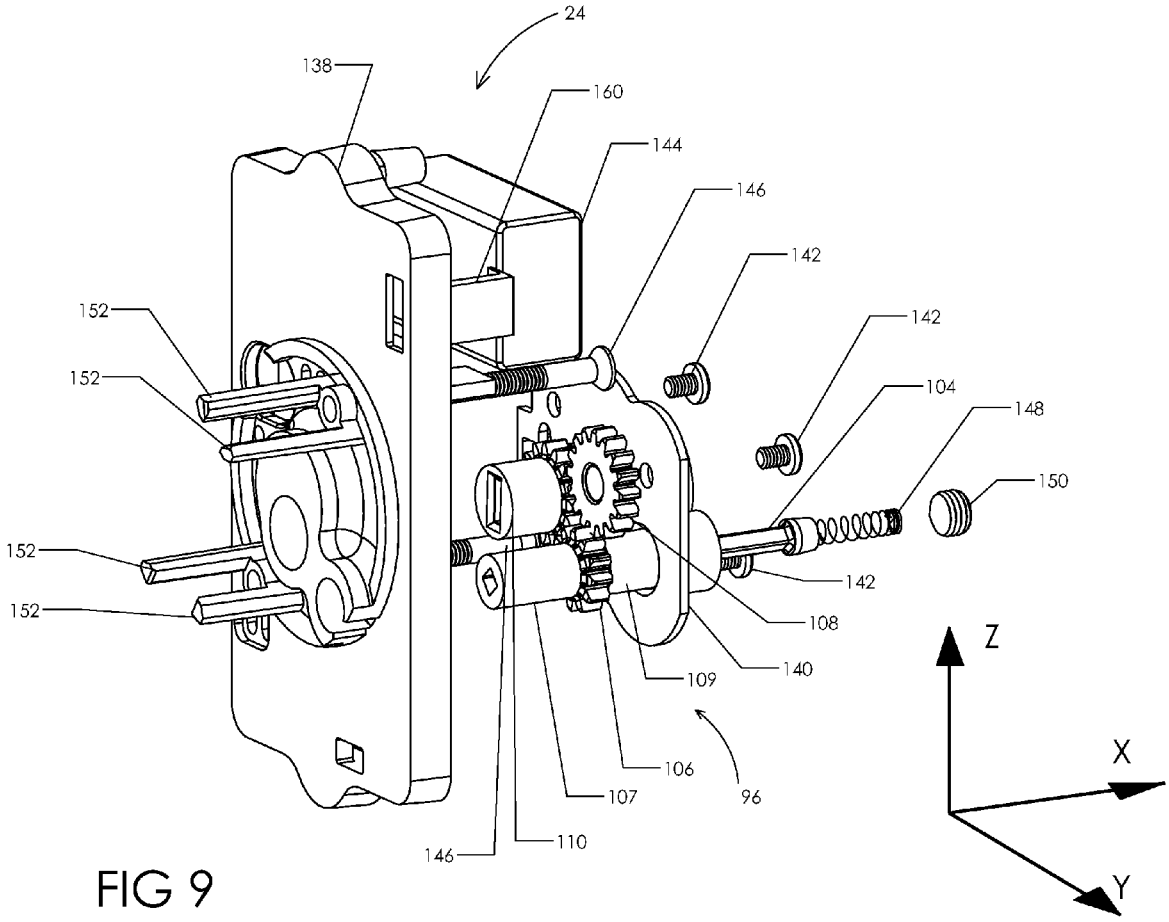
FIG. 9 is an exploded, close-up view of the interior sub-assembly of the FIG. 1 embodiment.

With reference to FIGS. 8 and 9 the internal sub-assembly 24 will be described. All of the gears of the interior gear train 96 are positioned and held in place as shown in FIGS. 1 and 9 by interior housing 138 and its interior housing cover 140. Cover 140 is fastened to the housing 138 by three screws 142. Housing 138 also supports battery power supply 144. Two mounting screws 146 fasten the housing 138 to the exterior housing 56 through the door 28. Clutch axle 104 extends along the x axis and through the center of gear 106. At the interior distal end of the axle 104 conventional compression spring 148 bias the axle 104 toward the exterior gear train 94. Spring 148 is held in place by set screw 150, which in turn is threaded into the interior gear 106, as shown in FIGS. 1 and 9. Four alignment extension members 152 function to align interior housing 138 properly with the exterior housing 56. Interior escutcheon plate 154 is fastened to the interior housing with two screws 156 as shown in FIGS. 1 and 8. Plate 154 holds interior thumb turn 158 which is attached in a conventional manner. Plate 154 also includes a battery holder 160, which is integral to the interior housing 138.

Latch Sub-Assembly

With reference to FIG. 1 the latch sub-assembly 26 will be described. Conventional deadbolt latch sub-assembly 26 includes faceplate 162, which is fastened to the door 28 by two screws 164. Sub-assembly 26 also includes a conventional tubular deadbolt latch 168 positioned to reciprocate between an extended position and a retracted position along the y axis in a conventional manner. The latch 168 also has a deadbolt latch actuator hub 170. The hub 170 has a horizontally oriented slot or channel extending along the x axis in alignment with the tailpiece 44 of cylinder 42. The hub 170 also has a vertically oriented slot or channel extending along the x axis as shown in FIG. 1 and implied in FIG. 5. The tailpiece 44 of the cylinder 42 extends through the one of the slots or channels. Rotation of the tailpiece 44 in a first direction causes the hub 170 to rotate in the same direction and this rotation causes the deadbolt latch to extend out of the door along the y axis. Similarly, rotation of the tailpiece 44 in the opposite or second direction will cause the hub to rotate and the latch to reciprocate and retract in the reverse direction along the y axis back into the latch sub-assembly.

Operation of the First Preferred Embodiment

With reference to FIG. 4-7, operation of the clutch mechanism will be described. When the axle of motor 74 rotates it drives worm drive gear 78. Rotation of worm drive gear 78 then functions to screw up, or down hairpin spring actuator 80, which in turn reciprocates piston 112 along the x axis into and out of a cavity in the transfer hub 126. When piston 112 is engaged with the transfer hub 126, the exterior gear train 94 is directly connected to the interior gear train 96. The exterior gear train 94 includes thumb turn spindle 50, first exterior gear 98, second exterior gear 100, third exterior gear 102 and clutch axle 104. The interior gear train 96 includes first interior gear 106, second interior gear 108 and third interior gear 110. When the exterior gear train 94 is connected to the interior gear train 96 and when thumb turn spindle 50 is rotated, the gear 110 rotates through this connection. When piston 112 is disengaged from the transfer hub 126, the exterior gear train 94 is independent of the interior gear train 96.

When piston 112 is disengaged, rotation of the thumb turn spindle 50 has no effect on the third interior gear 110.

With reference to FIGS. 1-7 the clutch and mechanical override mechanisms will be described. During normal operation the control system, once an authorized code is entered, will, for a predetermined period, preferably about five seconds, energize the motor 74 to engage the clutch. After the predetermined period has expired the control system will again energize the motor to disengage the clutch. The clutch mechanism is preferably actuated by motor 74 which includes axle 76, to which a worm drive gear 78 is preferably permanently attached. The motor 74 functions to rotate the axle 76 and worm drive gear 78 in a first direction to drive hairpin actuator or spring or spring actuator 80 along the x axis in a direction toward the interior or inside gear train 96. Thus, the actuator 80 moves from the position shown in FIG. 6 to the position shown in FIG. 7. The motor 74 includes two leads 75, 77, shown in FIGS. 6 and 7, and is fastened to motor mount or cover plate 88 with screws 90, one of which is numbered in FIG. 4. Rotation in the first direction causes the clutch to move from a disengaged position, shown in FIG. 6 to become engaged as shown in FIG. 7. Rotation of the motor 74 in the opposite or second direction causes the axle 76 and worm drive gear 78 to rotate in the second direction and thus to drive hairpin actuator 80 along the x axis in the opposite direction, and this will cause the clutch to be disengaged, i.e., from the position shown in FIG. 7 to the position shown in FIG. 6. When the clutch is engaged, the user can turn the external thumb turn to unlatch the door and permit it to be opened. A conventional cylinder sub-assembly 42 and its tailpiece, shown at 44 in FIG. 2 is positioned in the escutcheon plate in hole or bore 40 and has its tailpiece or spindle 44 extending in a direction along the x axis. As described above, the spindle 44 is directly coupled to the deadbolt latch 168. Thus, the present keypad deadbolt lockset has two axels for rotating the conventional latch hub 170, both of which axels extend though the single, standard 2 and ⅛ inch hole or bore in the door. In the event of a loss of power or of some other problem with the electronic control system that prevents the motor 74 from operating, the piston 112 will be in the retracted or clutch disengaged position, as described above. Then turning the key in cylinder 42 will cause the gear 110 to rotate due to the direct connection and permits the latch to be operated. The clutch is disengaged and rotation of the gears 110, 108 or 106 will not cause any rotation of the exterior gear train or the exterior thumb turn.

Figure 11:
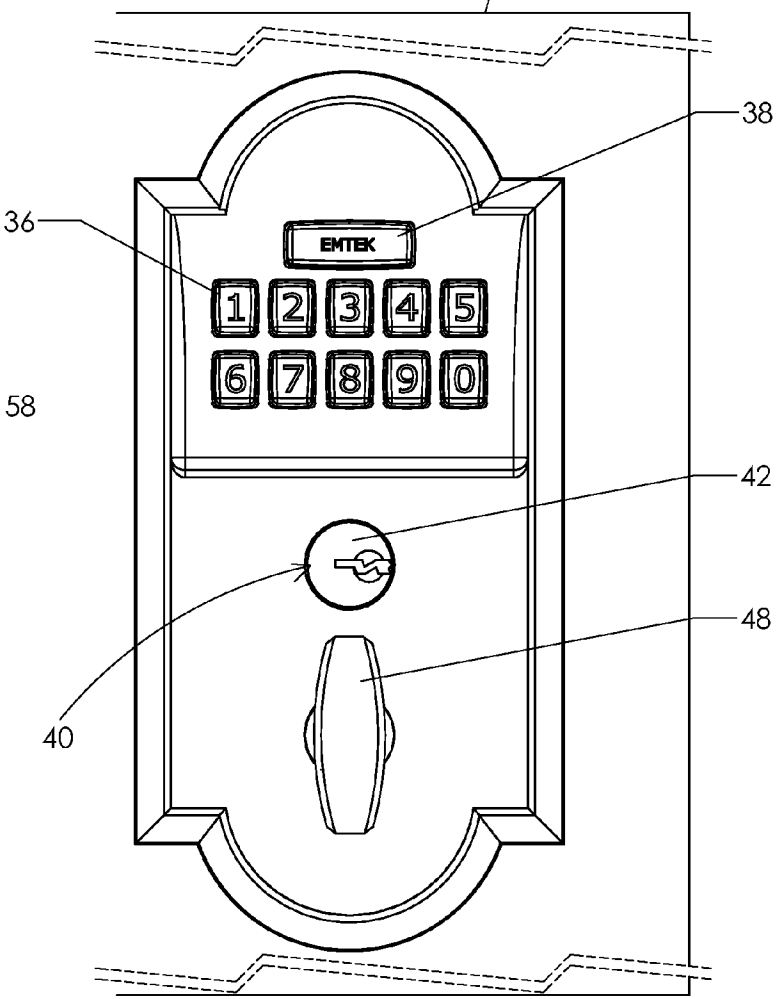
FIG. 11 is a front view of the FIG. 1 embodiment.
Figure 10:
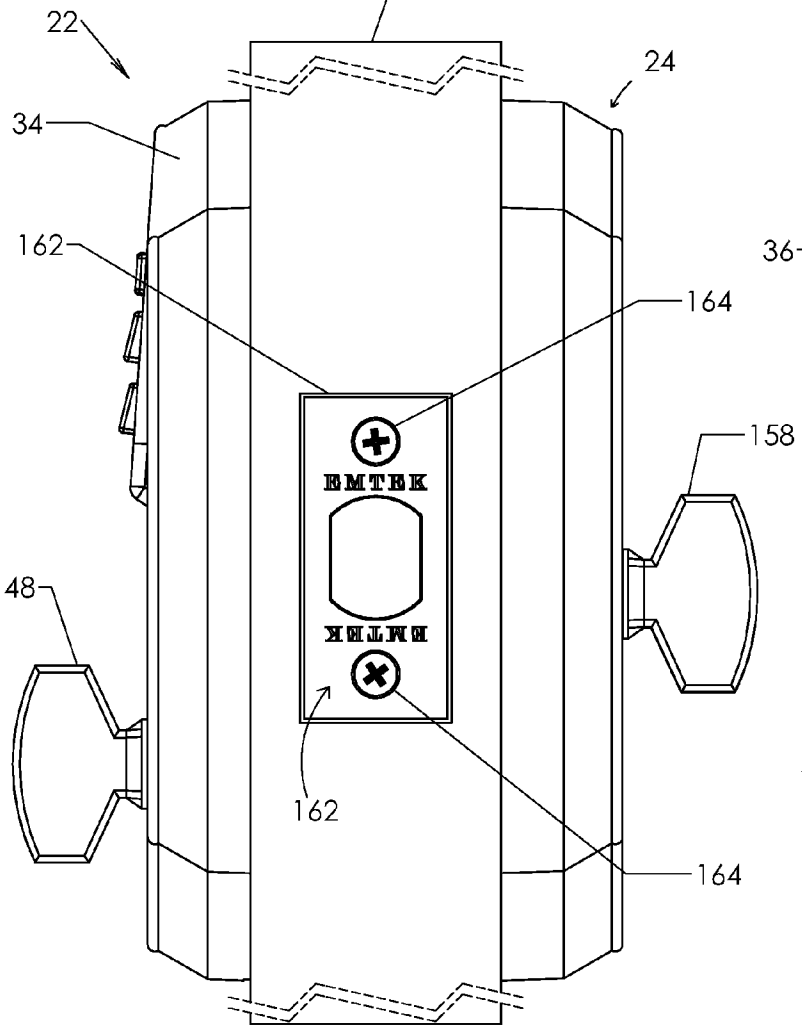
FIG. 10 is a side view of the FIG. 1 embodiment, as installed on a door.

Referring to FIGS. 10 and 11, a side view and front view, respectively of the dead bolt embodiment of the presently described lockset, outer thumb turn 48 and inner thumb turn 158 are shown in their home or resting positions. Latch assembly 22 includes an unnumbered latch bolt extending through a hole or bore in latch face plate 162, which is fastened to door 28 with screws 164. As shown in FIG. 11, cylinder 42 extends though bore 40 and is positioned below a grid for digits or other indicators, such as alphanumeric indications, shown here in a preferable, 2×5 grid having two rows and five columns of digits 36 for entry of codes into the electronic control system. Above the grid another indicator, shown in a rectangular form at 38, and that bears a product source identifier or some other information, and which may indicate or provide functionality, such as, when pressed, energizing a light source to highlight the digits.

Second Preferred Embodiment, Lever Actuated Keypad Lockset

Figure 12:
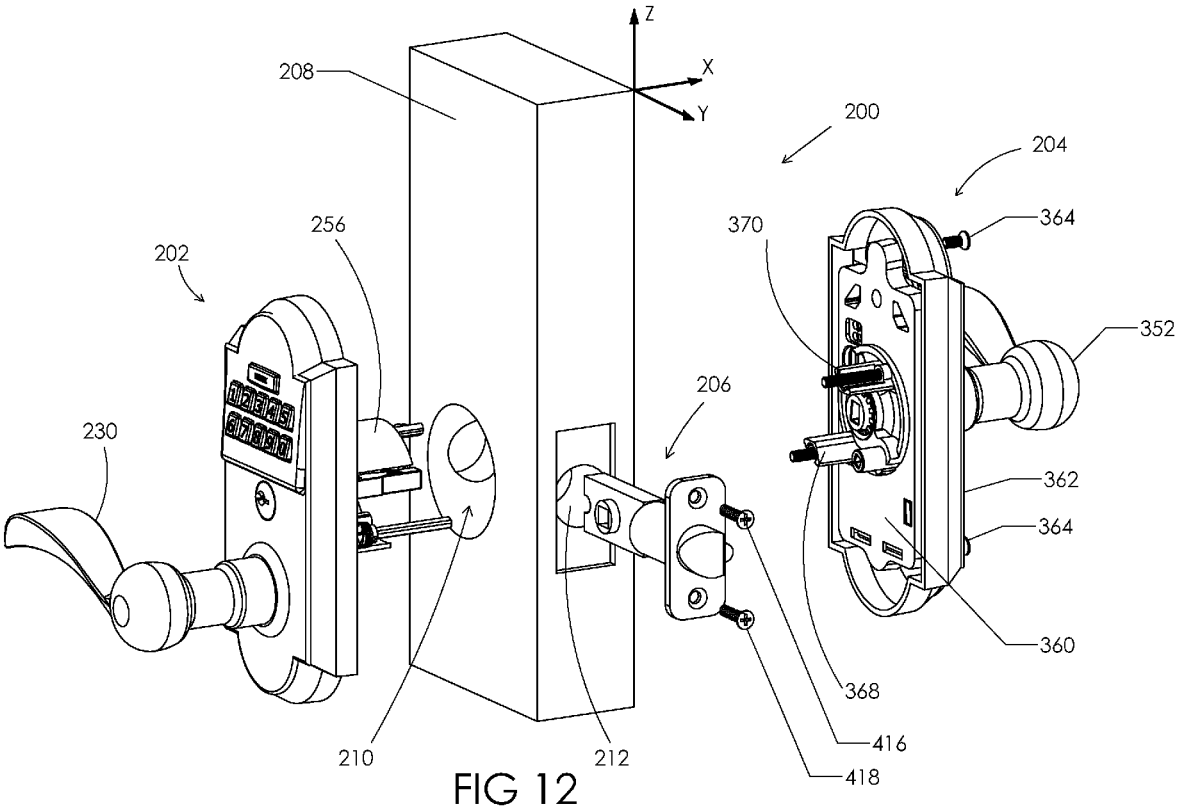
FIG. 12 is an exploded view of a second, lever type preferred embodiment keypad lockset.

In accordance with FIGS. 12-32 a preferred second, lever embodiment keypad lockset 200 will be described. The lockset 200 as shown in FIG. 12 is a lever actuated keypad lockset having an exterior or outside sub-assembly 202, an interior or inside sub-assembly 204 and a latch sub-assembly 206. Lever actuated lockset 200 is adapted for use with a standard preparation for a door 208, including a conventional 2 and ⅛ inch diameter bore or hole 210 through the door along the x axis and a 1-inch diameter bore or hole 212 that extends through the door along the y axis from the edge of the door to the bore 210.

The lever embodiment keypad lock 200 also has a low profile design that preferably has an exterior sub-assembly lock thickness of less than 1 inch from the door to the outside surface of the exterior escutcheon plate for aesthetic reasons. In this embodiment the cylindrical shroud 256 of the outside housing 244 extends into the existing 2-⅛" hole or bore 210 in the door. Also, conventional dead latch assembly 206 extends though a standard 1" bore 212 along the y axis into the door from the outer edge into the bore 210. The lock 200 also has two four-bar linkages that operate, once the proper code has been entered and the lever handle 230 has been rotated, to unlatch the lock and permit opening the door, as described in detail below. The axis of rotation of lever handle 230 is offset from the axis of rotation of the spindle 336 through operation of an external 4-bar linkage that generates a parallel axis of rotation when the clutch is engaged. This external 4-bar linkage transmits input torque from the lever handle 230 through the clutch to the internal 4-bar linkage which, in turn, rotates to retract the dead latch bolt. The external 4-bar linkage translates a 45-60 degree lever handle input angle into a 90 degree output angle that is required to completely retract the dead latch bolt as will be described in further detail.

The cylinder and the inside lever performs direct drive motion to retract the latch bolt. When the exterior or outside lever is rotated, the resulting torque is transmitted to the clutch axis through a 4-bar linkage. The motor activates a piston pin to engage a transfer hub that integrates both sides of the clutch to connect together. The clutch axis transfers torque from outside into the input housing. Another 4-bar linkage connects the clutch axis to the cylinder main drive axis that in turn causes the latch bolt to retract. [stop-stop]

Exterior or Outer Sub-Assembly

Figure 13:
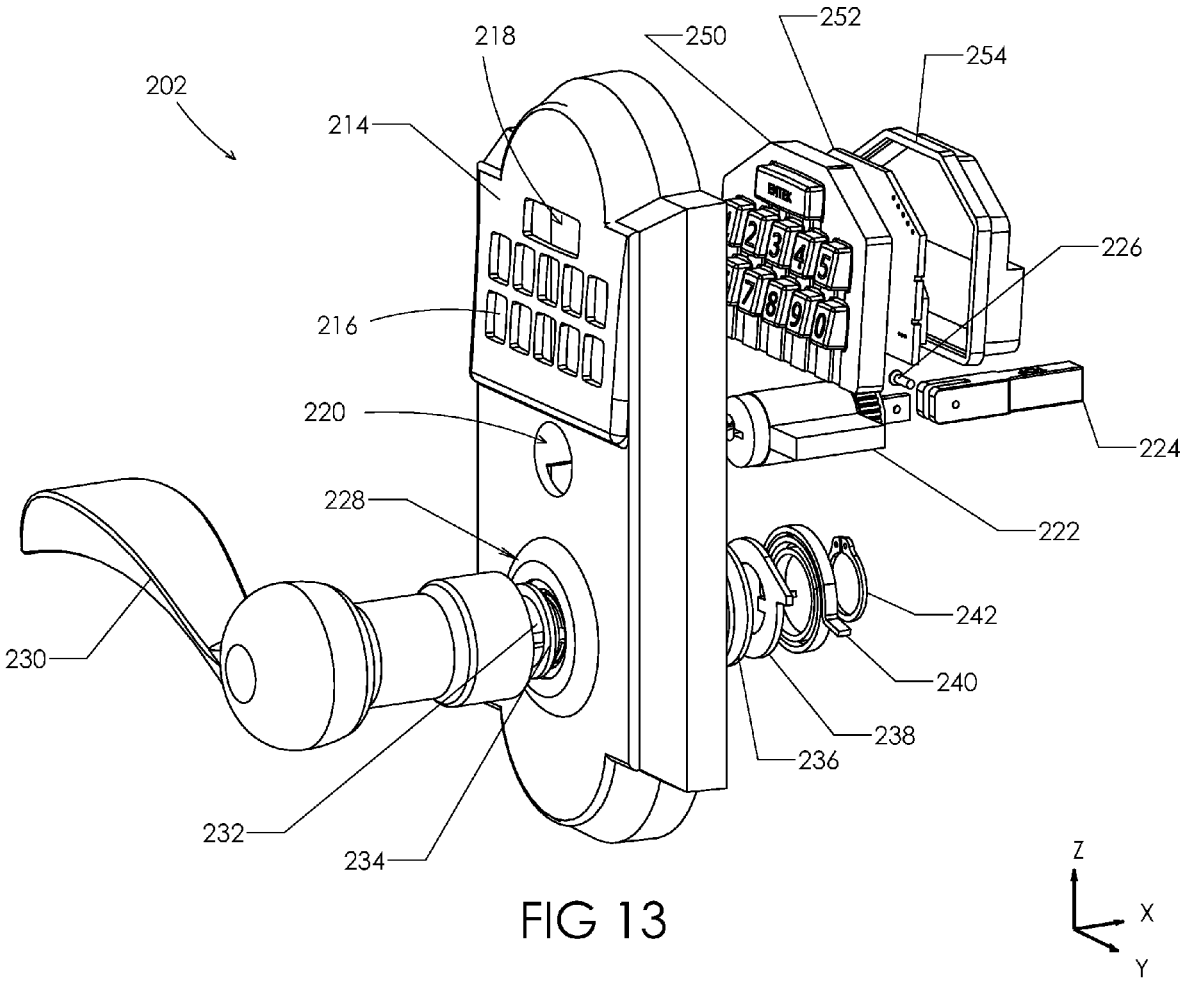
FIG. 13 is an exploded view of the exterior or outer plate and lever of the FIG. 12 embodiment.

Referring to FIGS. 12 and 13 the exterior or outside escutcheon plate 214 preferably includes a 5 by 2 array of holes to accommodate keys for the electronic control system, one of which is shown at 216. As will be appreciated a different number of holes and different configurations for the key holes, keys and escutcheon plates are within the ordinary skill of the art in this field. Escutcheon plate 214 also includes rectangular opening or hole 218 for an additional indicator, such as a product identifier, another key for operation of the control system or for an indicator, such as an LED indicator of the status of the electronic control system of the lockset.

Hole or bore 220 is sized and positioned to accommodate a conventional cylinder 222, to which cylinder spindle or tailpiece 224, also referred to as an upper spindle, is connected with pin 226. Spindle 224 extends along the x axis and functions to operate an override mechanism as will be further described. The lower part of escutcheon plate 214 includes a hole 228 that is sized and positioned to accommodate lever 230 and associated components including spindle 232 which is also referred to as a lower spindle, shoulder washer 234 and shim or washer 236 to retain the lever 230. Timing plate 238, torsion spring 240 and c-clip 242 are also positioned about and on lower spindle 232.

Figure 14:
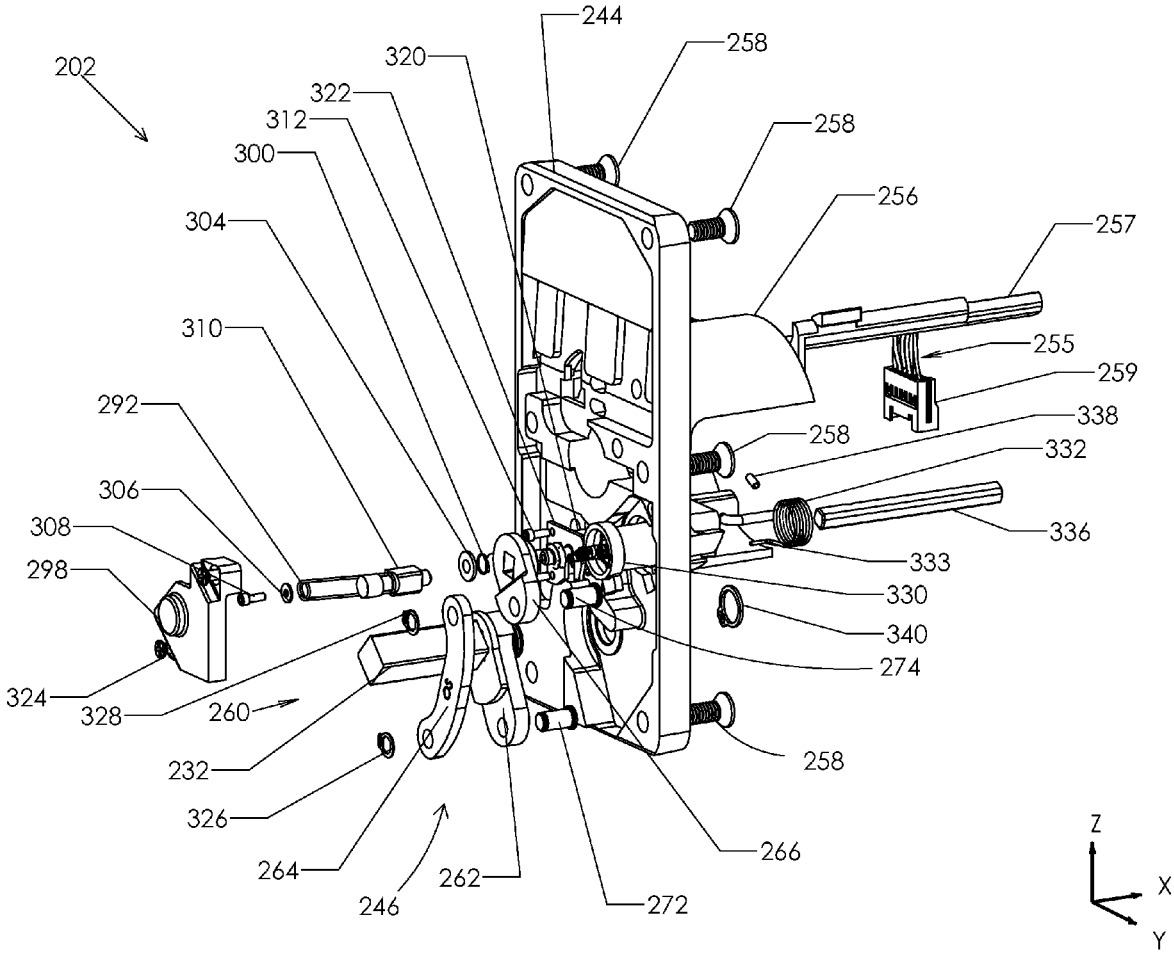
FIG. 14 is an enlarged exploded view of portions of the exterior sub-assembly of the FIG. 12 embodiment.

Referring to FIGS. 12, 14, 15 and 22, exterior or outer sub-assembly 202 includes exterior housing 244, which is preferably a zinc die cast and functions as the support, base or anchor for the exterior clutch mechanism or sub-assembly 246 and for electronic control sub-assembly 248. Electronic control sub-assembly 248 includes rubber keypad 250, circuit board 252, circuit board housing or tub 254. Housing 244 includes an internally extending alignment flange or shroud 256. Shroud 256 is preferably integral with the housing 244 and functions to align the exterior clutch sub-assembly 246 with the door 208 for proper mating with the interior housing sub-assembly 204. Extending from shroud 256 cable guide 257 provides a protected path for wiring 255 to extend from the circuit board 252 to the power supply and to the motor 286, and is shown extending to connector 259. Exterior housing 244 is preferably fastened to the outside escutcheon plate 214 with six screws 258, four of which are shown in FIG. 14.

With reference to FIGS. 12 and 14-18 exterior clutch sub-assembly 246 includes an exterior four-bar mechanical linkage 260. Such linkages are well known in the field of kinematics. Also known simply as a 4-bar or four-bar, this mechanical linkage consists of four rigid bodies, referred to as bars or links, each typically attached to two others by single joints or pivots to form a closed loop. One link typically does not move, and this link is typically referred to as the anchor, ground link, fixed link or the frame. In the second preferred embodiment the exterior housing 244 is the anchor or fixed link for the exterior 4-bar linkage 260, with the first, second and third movable links referred to as spindle cam 262, cam link 264, and third link 266, respectively.

Figure 17:
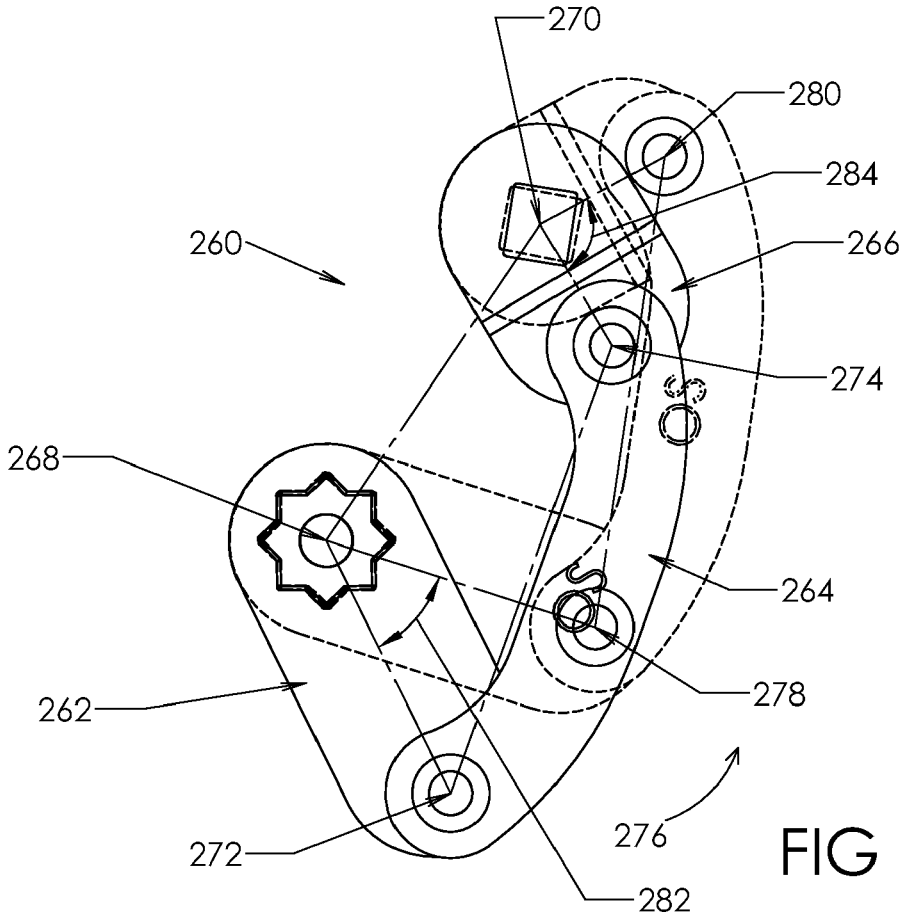
FIG. 17 is a schematic, or free body diagram view of the outer four bar mechanical linkage of the FIG. 12 embodiment.
Figure 23:
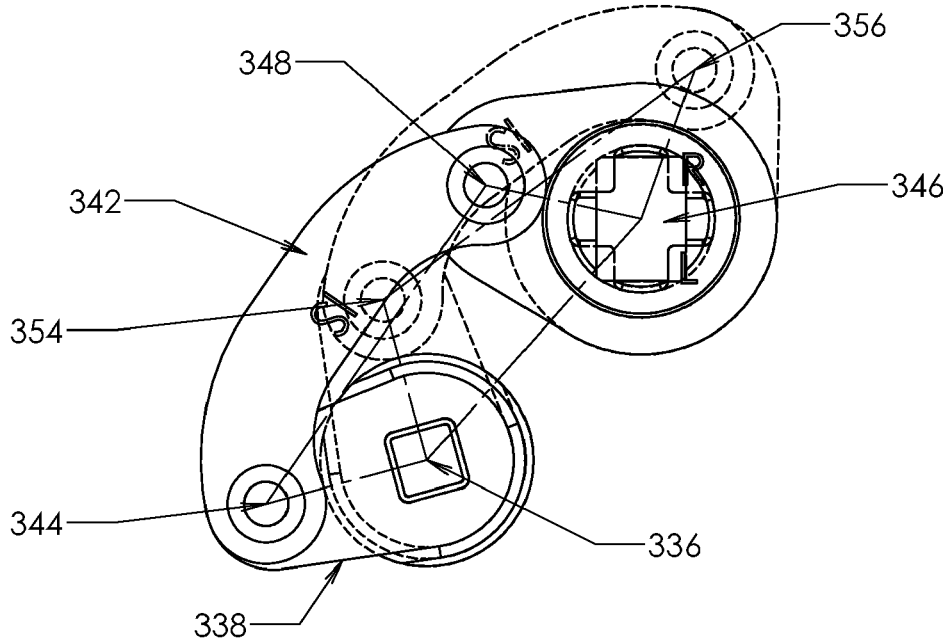
FIG. 23 is a schematic, or free body view of the inner four bar mechanical linkage of the FIG. 12 embodiment.

To assist in explaining the operation of the clutch mechanism sub-assembly 246 a free-body diagram of the exterior or outside 4-bar linkage 260 is provided in FIG. 17. Exterior linkage 260 is shown in its home position in solid lines with fixed pivots shown at 268 and 270. The home position of pivots 272 and 274 are also shown in FIG. 17. When the first link, i.e., spindle cam 262 is rotated in a counterclockwise direction, as indicated by arrow 276, due to turning of the exterior lever 230 when the clutch is engaged, then the pivot point 272 moves to a new position, shown at 278. As a consequence of the relative positioning and relative lengths of the links in the linkage, each to the other, the home pivot point shown at 274 is driven to a new or rotated pivot point, shown at 280. The pivots at pivot points 272 and 274 are retained in place to connect their adjacent links by c-clips 326, 328, respectively. The angle formed between drive pivot points 272 and 278 as spindle cam 262 is rotated from its home position to fully rotated position is shown as angle 282. In the most preferred lever embodiment angle 282 is about 45 degrees and preferred angles are in the range of about 40-60 degrees. The angle formed between driven pivot points 274 and 280 as the third link 266 is driven by cam link 264 and rotated about pivot point 270 is shown as angle 284. In the most preferred lever embodiment angle 284 is about 90 degrees. In other words, a 45-degree rotation of the exterior or outside lever 230 translates to swinging or rotating the $3^{rd}$ link 266 a total of about 90 degrees through the connecting arm, i.e., the $2^{nd}$ link 264, also referred to cam link 264. Thus, the entire swing motion of the 4-bar linkage translates the input torque from the outside lever to the clutch axis.

Figure 21:
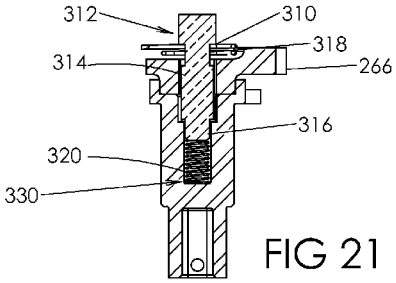
FIG. 21 is a top, cross-sectional view of a portion of the outer part of the outer clutch sub-assembly of the FIG. 12 embodiment in a clutch engaged position.
Figure 20:
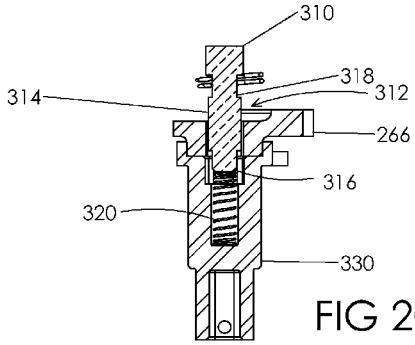
FIG. 20 is a top, cross-sectional view of a portion of the outer part of the outer clutch sub-assembly of the FIG. 12 embodiment in a clutch disengaged position.
Figure 19:
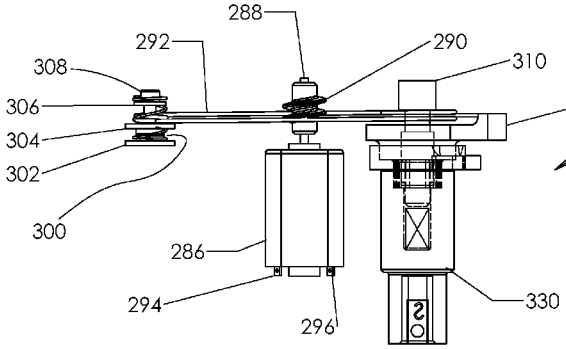
FIG. 19 is a top view of the FIG. 18 motor coupled to the exterior four bar mechanical linkage of the FIG. 12 embodiment in a clutch engaged position.

Referring to FIGS. 16 and 18-21 the clutch sub-assembly 246 is preferably actuated by motor 286, preferably a DC motor, which includes axle 288, to which a worm drive, or worm gear 290 is preferably permanently attached. The motor 286 functions to rotate the axle 288 and worm drive gear 290 in a first direction to drive hairpin actuator or spring or spring actuator 292 along the x axis in a direction toward the interior or inside sub-assembly 204. Thus, the actuator 292 moves from the position shown in FIG. 18 to the position shown in FIG. 19. The motor 286 includes two leads 294, 296, shown in FIGS. 18 and 19, and is fastened to motor cover plate 322 with screws 324, one of which is numbered in FIG. 16. Rotation in the first direction causes the clutch to move from a disengaged position, shown in FIGS. 18 and 20 to become engaged as shown in FIGS. 19 and 21. Rotation of the motor 286 the opposite or second direction causes the axle 288 and worm drive 290 to rotate in the second, opposite direction and thus to drive hairpin actuator 292 along the x axis in the opposite direction, i.e., from the position shown in FIGS. 19 and 21 to the position shown in FIGS. 18 and 20. This will cause the clutch to be disengaged, i.e., from the position shown in FIG. 21 to the position shown in FIG. 20.

Figure 16:
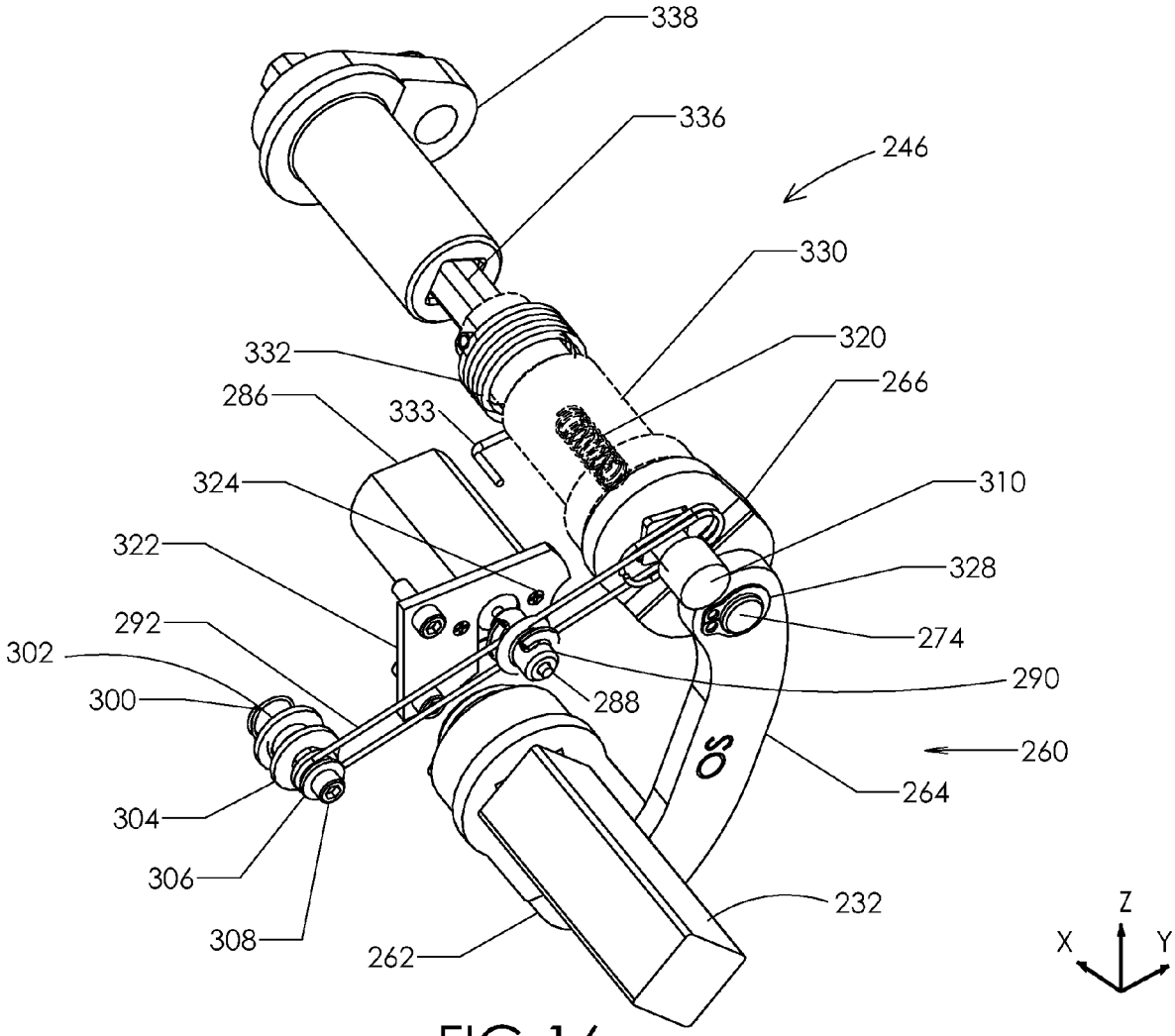
FIG. 16 is an enlarged view of the exterior four bar mechanical linkage of the FIG. 12 embodiment.
Figure 18:
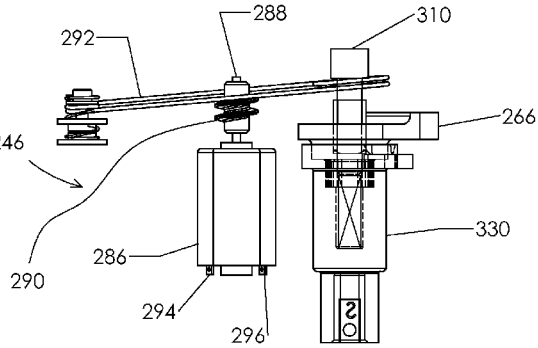
FIG. 18 is a top view of a motor coupled to the exterior four bar mechanical linkage and outside portion of the clutch of the FIG. 12 embodiment in a clutch disengaged position.
Figure 22:
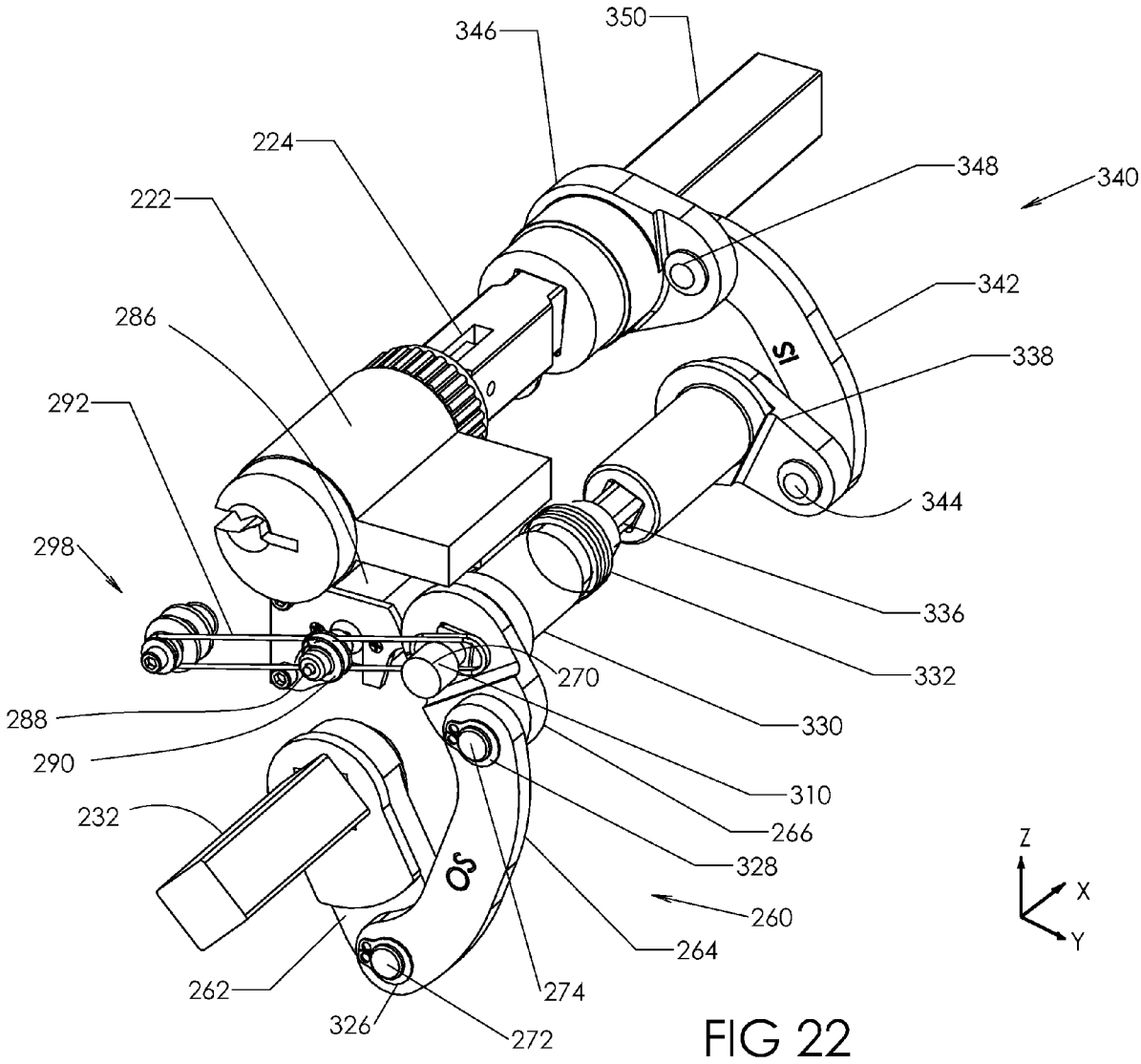
FIG. 22 is a close-up view of the outer and inner clutch sub-assemblies of the FIG. 12 embodiment.

As shown in FIGS. 16 and 18, the clutch exterior 4-bar linkage 260 and clutch sub-assembly 246 include a screw fulcrum or anchor 298 positioned at a first or anchor end of the clutch hairpin actuator 292. The anchor 298 includes an anti-vibration coil spring 300, two anti-vibration washers, 302, 304, washer 306 and screw 308, which together function to anchor or keep the first end of the clutch actuator 292 in a fixed position relative to its opposite or second end. At its second end the clutch actuator 292 is looped around and movably retained by clutch piston cover or head 310. As shown best in FIGS. 20 and 21, clutch piston 312 includes a main body 314, a drive end 316, a reduced radius neck 318 and head or cover 310. The diameter extending along the y axis and the length of the neck 318 extending along the x axis provide a relatively small circumferential axle about which the second end of the actuator 292 is looped and a relatively small arc within which the second end of the actuator 292 can move. As is readily apparent from FIGS. 16-19, the relatively large diameter cover or head 310 retains the actuator in position to reciprocate the clutch piston 312 along the x axis and thus to engage and disengage the clutch. Piston spring 320 is positioned within socket 330 and provides a biasing force against piston 314. Spring 320 is shown in its extended and compressed positions in FIGS. 20 and 21, respectively.

Figure 15:
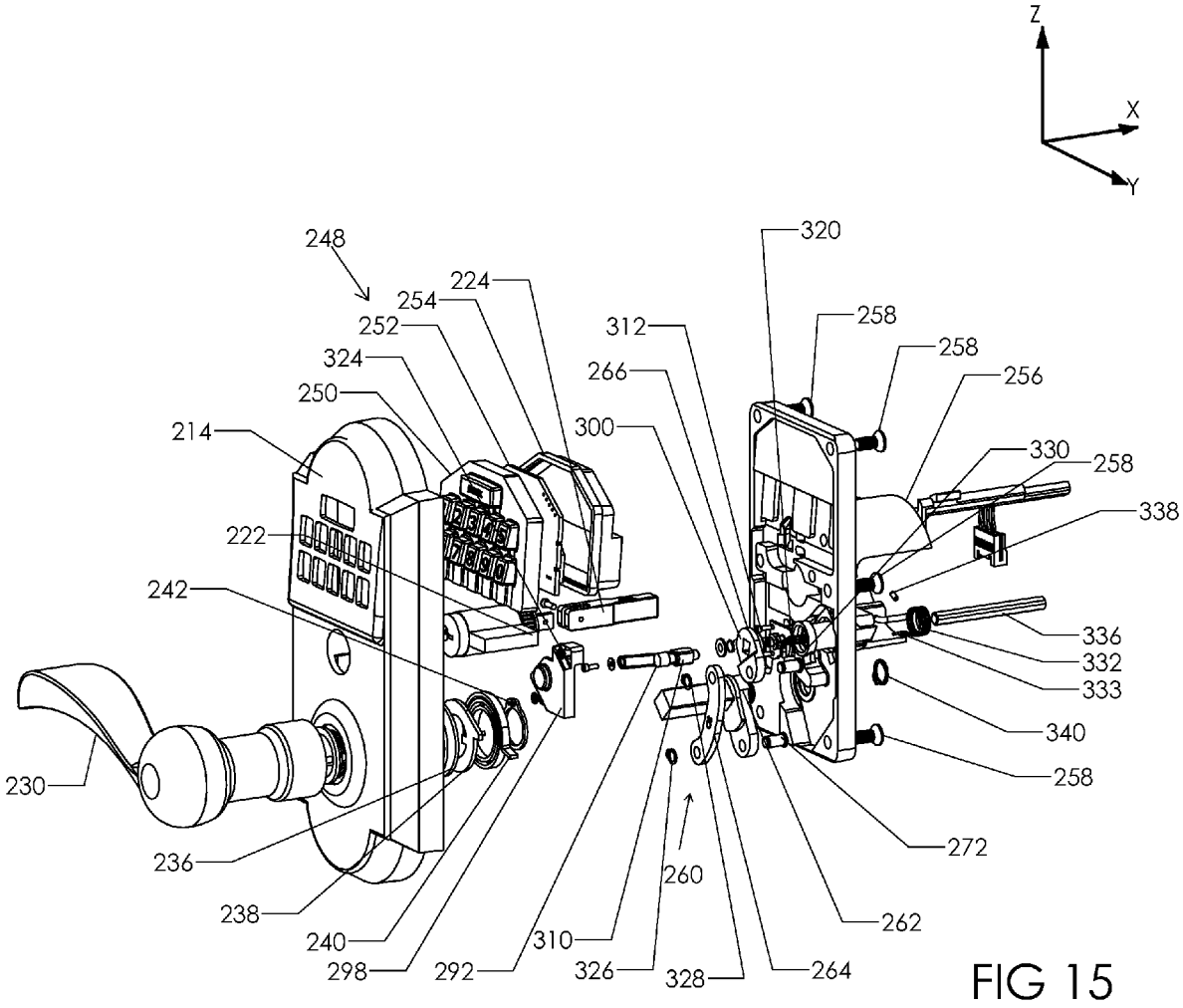
FIG. 15 is an exploded view of the outer sub-assembly, including view of the clutch sub-assembly and out four bar mechanical linkage of the FIG. 12 embodiment.

Torsion spring 332 is positioned about the first or exterior end of transfer hub or socket 330. Spring 332 and its clutch positioning leg 333, shown in FIGS. 14 and 16, function to bias the transfer hub or socket 330 so that it remains in proper alignment with piston 312, to thereby assure engagement of the clutch upon rotation of the motor in the first direction, as described above. The second or interior end of the transfer hub retains spindle or clutch bar 336, which is the clutch member that transitions from the exterior or driving end of the clutch to the interior or driven end of the clutch. The pin 338 pushes into transfer hub 330 to retain square shaft 336 and hold the torsional spring from riding up on the hub. C-clip 340 holds assembly 262 to the base plate as shown in FIG. 15.

Interior Sub-Assembly

With reference to FIGS. 16, 19, 20, 23 and 24 the interior or inner sub-assembly will be described, beginning with the inner 4-bar linkage 340 that is coupled to the outer 4-bar linkage through the clutch. Spindle 336 extends into transfer cam 338, which is the first link of the interior 4-bar linkage 340. Cam or link 338 is connected to the second link 342 at pivot or pin 344, and is connected to the third cam or link 346 at pin or pivot 348. Extending through the other pivot of cam or link 346 is the cylinder spindle 224 and spindle 350 of inner lever 352, and with spindle washer 351. A free-body diagram of the inner four-bar linkage is provided as FIG. 23 with the solid line representation of the linkage in its home or resting position. Rotation of the spindle 336 through an angle of 90 degrees causes cam or link 338 to rotate 90 degrees and the pivot at 344 to move to its rotated position at 354, with link 342 moving upward or downward, to cause the pivot at 348 to rotate 90 degrees to the position shown at 356. As will be appreciated, for a right-hand lockset installation this rotation will be upward and for a left-hand lockset installation this rotation would be in the opposite direction to cause a downward motion. Thus, rotation of the clutch axis translates the outer 90 degree swing angle to the inside 4-bar linkage $1^{st}$ link through the engagement of the piston pin and the transfer hub of the clutch. A lost motion cam of the $3^{rd}$ link then operates to cause rotation of the latch bolt spindle 90degrees through the inner 4-bar linkage which in turn leads to retraction of the latch bolt of the sub-assembly 206, as described in greater detail below.

As with any mechanical transmission, the internal transmission mechanism of the presently described lever embodiment locksets will have efficiency loss due to friction and mechanical advantage losses inside the mechanism. Traditional mechanical lever locks are designed for both outside and inside levers to be activated during the unlock function. Typically, in conventional locksets two torsion springs are used, one spring for each of the levers, to unlock the door. In preferred embodiments of the present locksets, however, the inside and outside levers are detachable, thus enabling only one of the levers to rotate while the other lever remains idle. As a result, the gain in efficiency in operation of the input lever can compensate for any internal mechanism efficiency loss.

Figure 27:
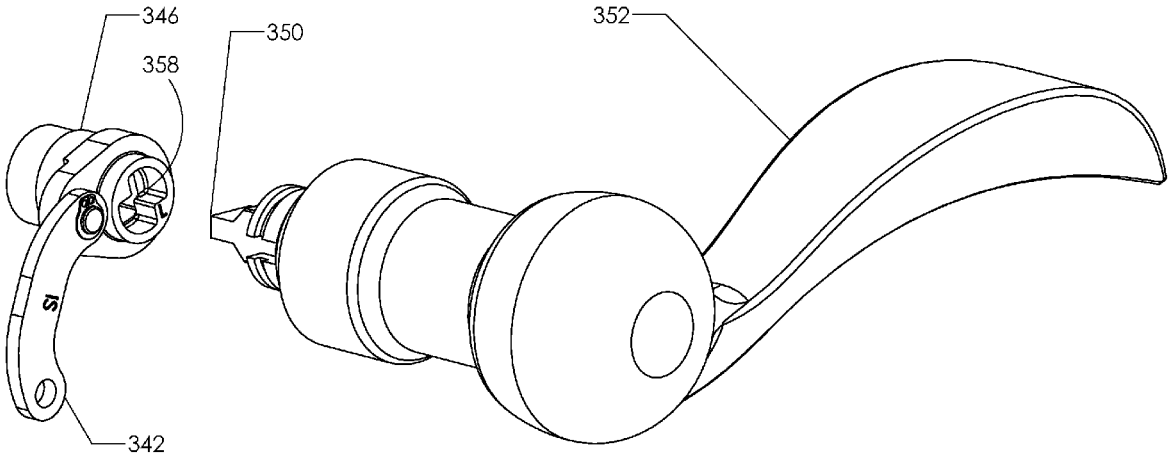
FIG. 27 is an exploded view of the inner lever and lost-motion link feature of the FIG. 12 embodiment.

The lost motion cam is preferably in the $3^{rd}$ link of the inside 4-bar linkage, and is where the drive bar of the inside lever resides. This cam preferably has material removed to form a cavity that permits no engagement with the drive bar when the cam is being driven by the $1^{st}$ linkage from the clutch axis. The preferred cam and its drive bar interface are shown in FIG. 27, where cam 346 has a cavity 358 shaped and positioned such that movement of the link 342 through 90 degrees is motion that is lost, i.e., the link will have to rotate more than 90 degrees in order to cause the drive bar or spindle 350 to rotate. In other words, the amount of the lost motion travel in the cam 346 is about 90 degrees, so that the cam must rotate at least about 90 degrees before it engages the drive bar 224 to then cause the drive bar 224 to rotate and unlatch the door, yet not rotate the inside handle 352. As is also apparent from FIGS. 27 and 22, rotation of the inner handle 352 will cause its spindle 350 to immediately engage the drive bar 224 to rotate and unlatch the door. This aspect of the present preferred lever lockset provides an efficiency gain in input power that can compensate for any efficiency loss that occurs within the mechanism.

Figure 24:
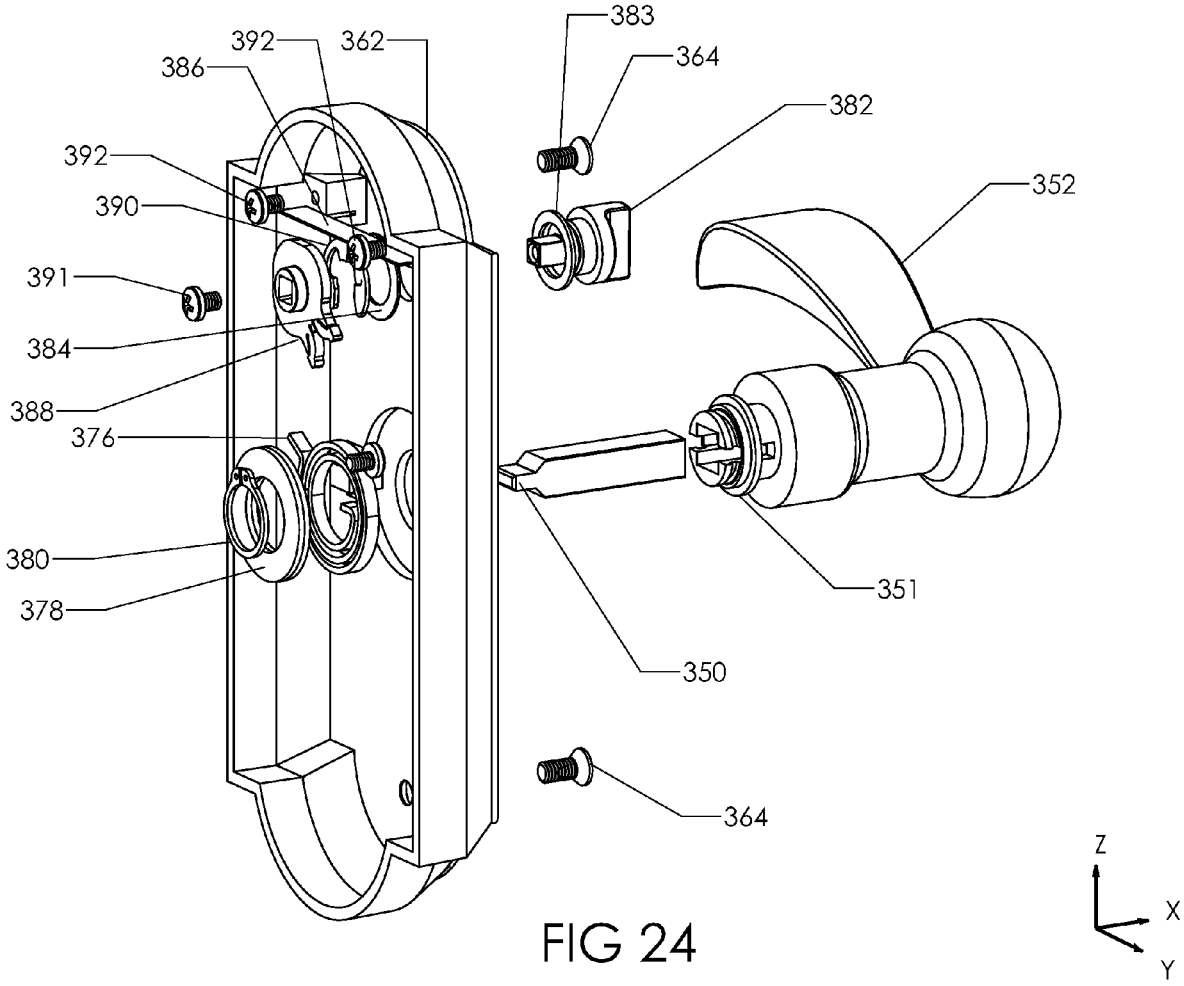
FIG. 24 is a close-up view of part of the interior or inner sub-assembly of the FIG. 12 embodiment showing the inner lever and pass-through thumb turn.
Figure 25:
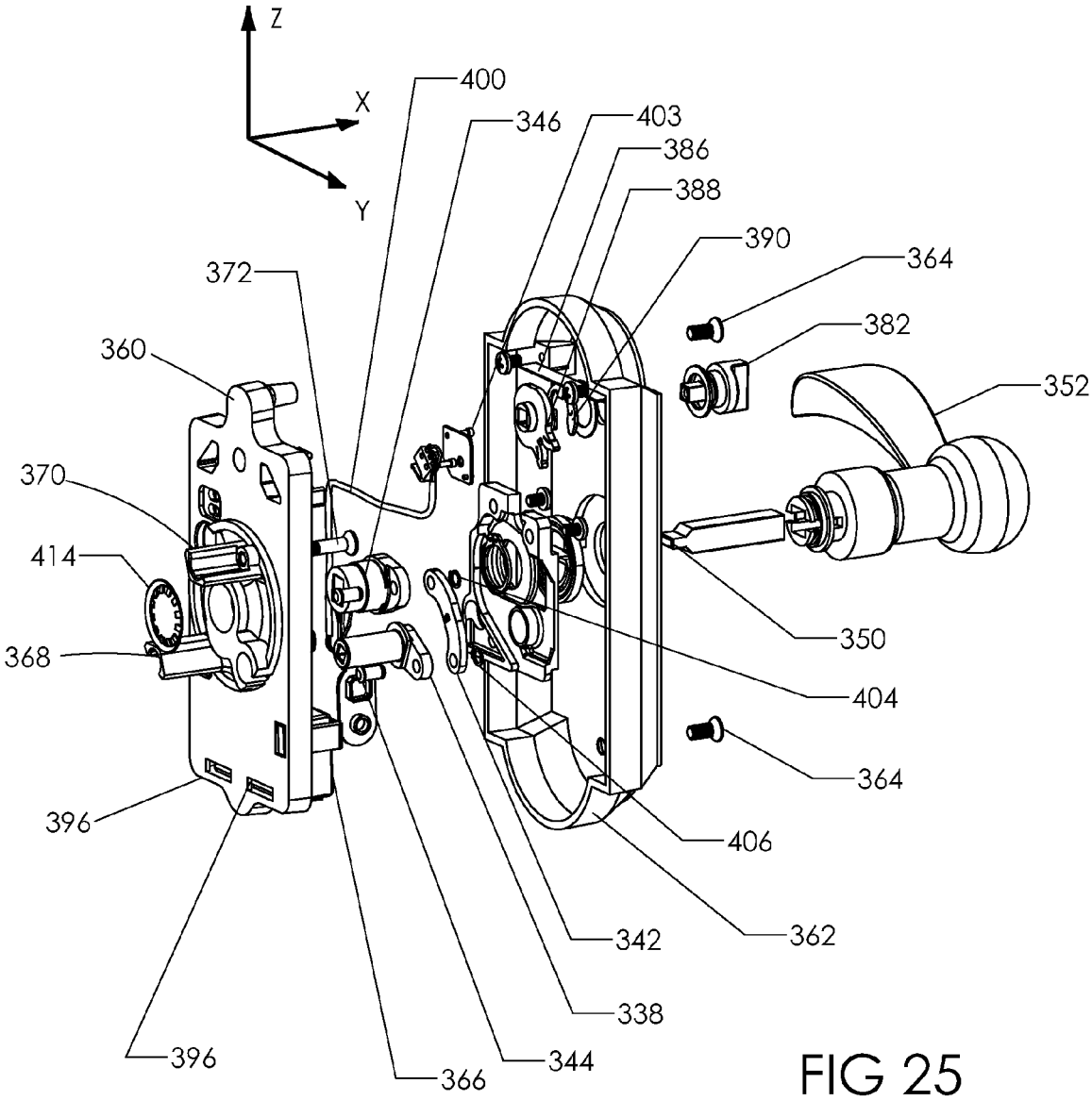
FIG. 25 is a close-up view of additional parts of the inner sub-assembly of the FIG. 12 embodiment.
Figure 26:
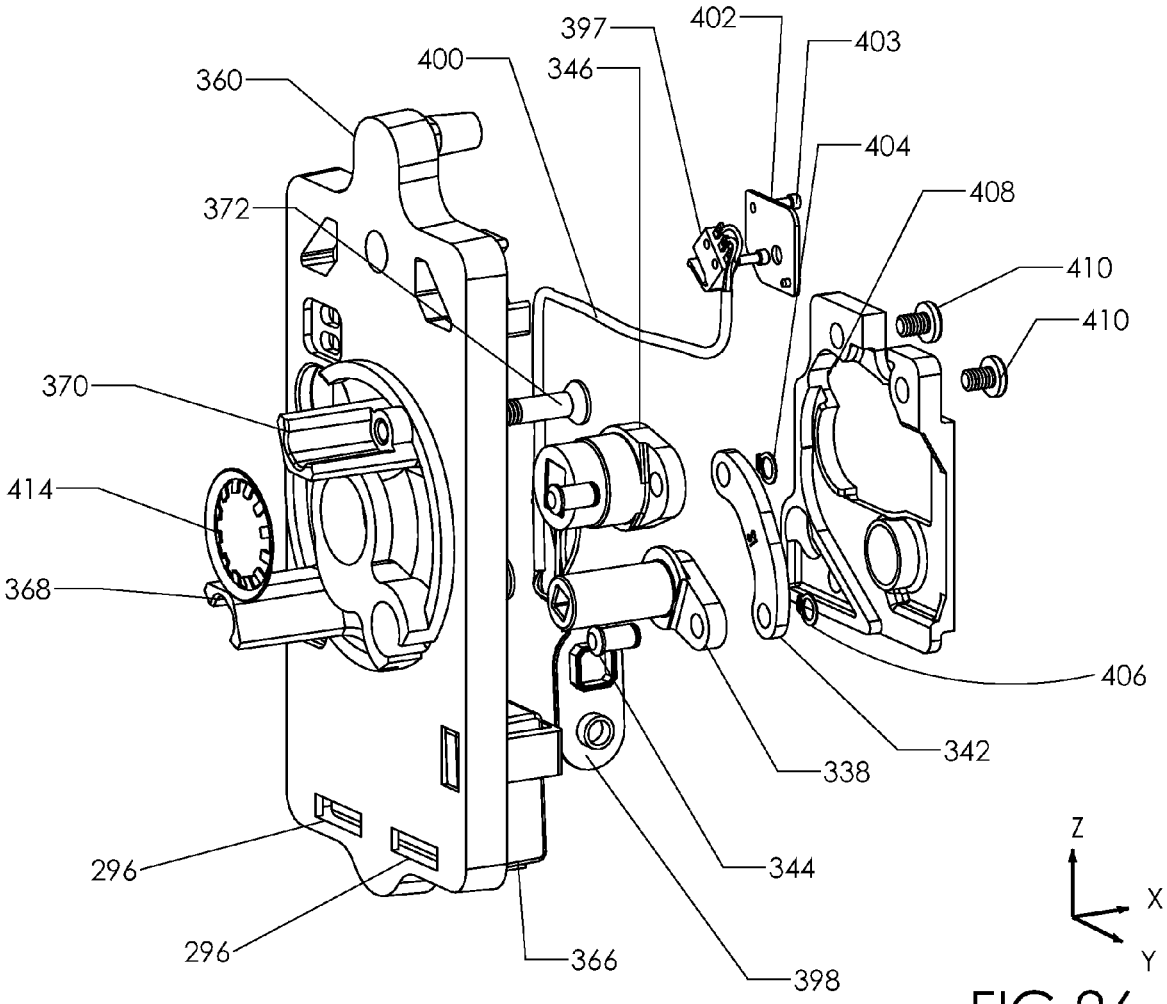
FIG. 26 is a close up view of the inner four bar linkage, linkage cover and inner housing of the FIG. 12 embodiment.

With reference to FIGS. 12 and 24-32 additional and alternate features of the internal sub-assembly 204 will be described. The various components are positioned and held in place by inner or interior housing 360 and its interior housing cover 408, by screws 410, two of which are shown in FIG. 26, and the escutcheon plate 362. Cover 362 is fastened to the housing 360 by screws 364. Housing 360 also supports battery power supply 366. Two alignment extension members 368, 370 align interior housing 360 properly with the exterior housing 244 through two screws, one of which is shown at 372. Lever return spring 376, washer 378 and c-clip 380 function in a conventional fashion and are shown in FIG. 24. Also, c-clips 404 and 406 are shown retaining the link 342 on its pivots.

Figure 28:
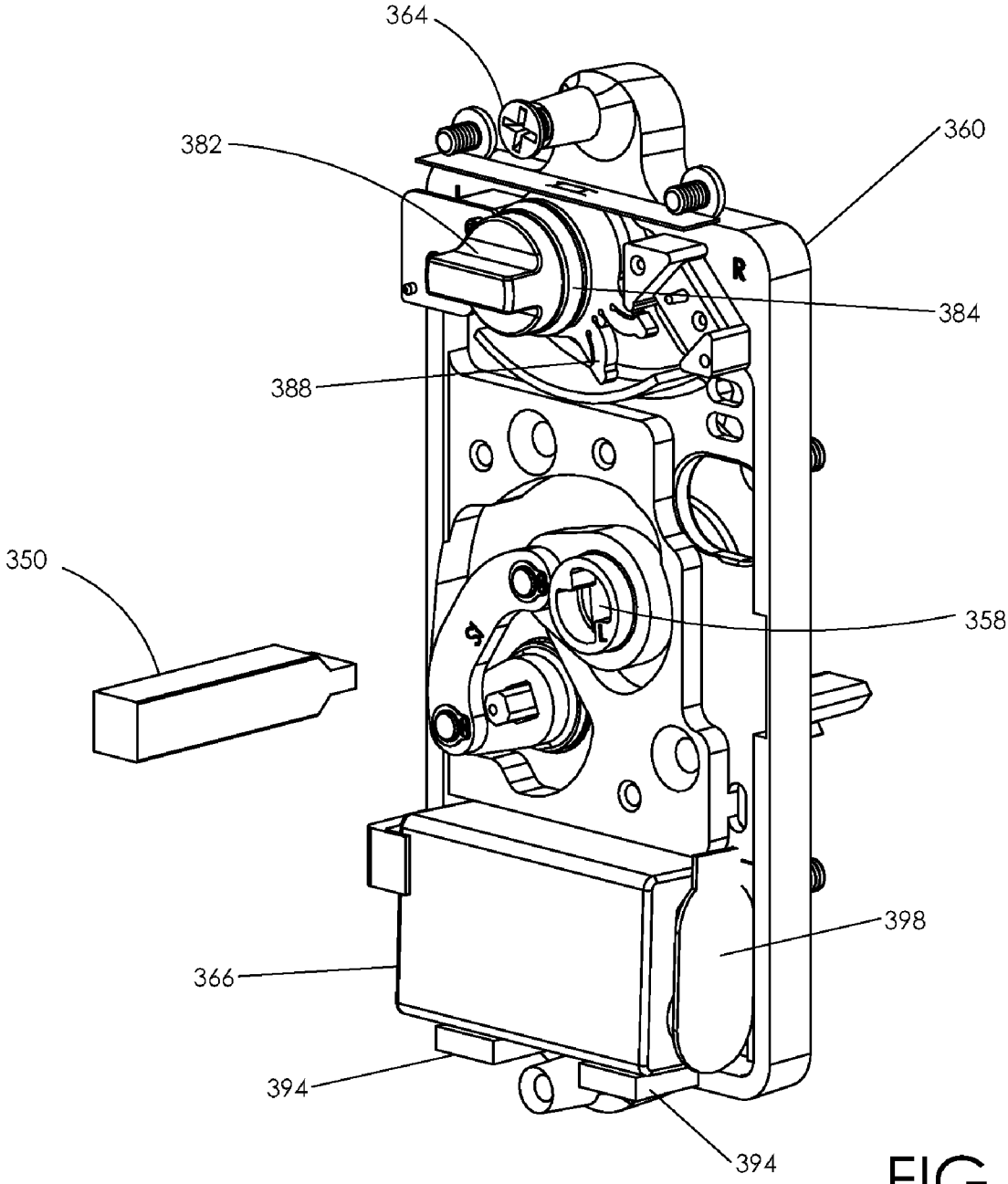
FIG. 28 is an enlarged view of the inner side of the inner sub-assembly housing of the FIG. 12 embodiment.
Figure 29:
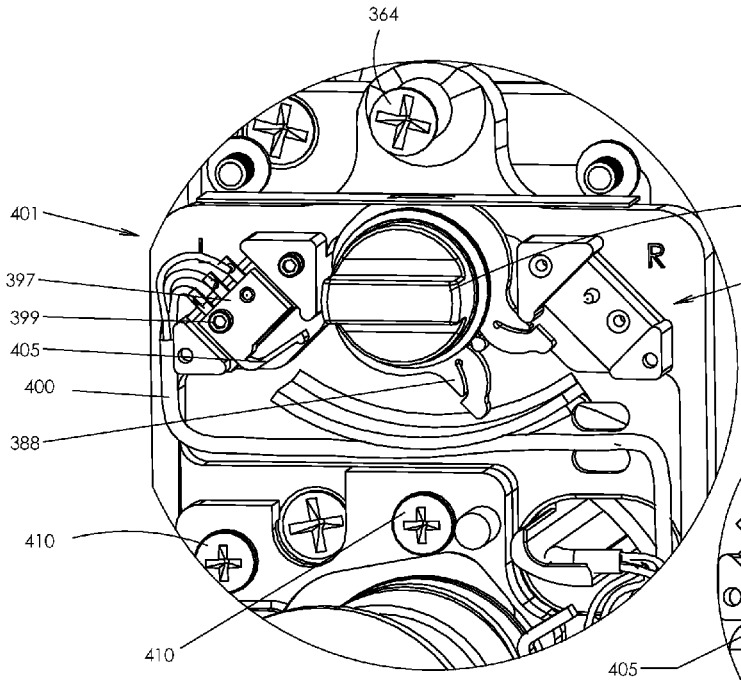
FIG. 29 is a close up view of the inner sub-assembly and pass through thumb turn and signaling micro-switch of the FIG. 12 embodiment.
Figure 29A:
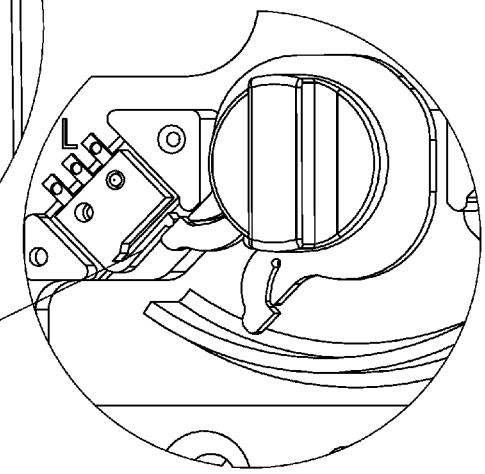
Figure 30:
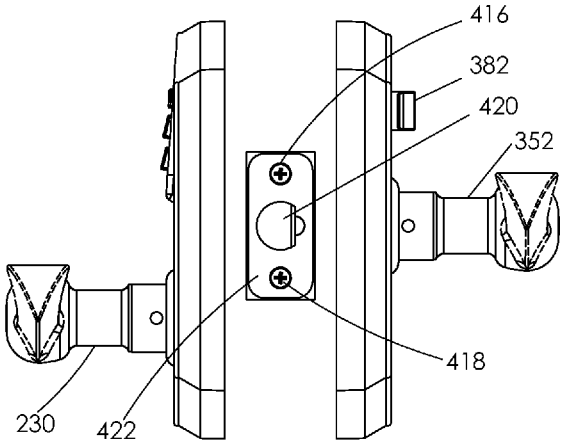
FIG. 30 is a side view of the FIG. 12 embodiment, as installed on a door.

The lever embodiment lockset includes a passage thumb turn 382 and washer 383, positioned near the top of and extending inward of the lockset, as shown in FIG. 24. Inside of the cover plate 362 a thumb turn shim 384, a cam spring 386, a cam 388, and a retaining clip 390 are positioned to permit the electronic control to be changed from a secure or locked state to a passage or pass through state when the user wants the door to be unlatched without having to use the code or a metallic key override. For example, in the event the home owner is hosting a party and wants to permit guests to freely enter the house through the front door without using a key code or a metallic key override, the owner would set the thumb turn to passage mode. In this mode the owner would not have to come to the door each time a new guest arrived, would not have to prop open the door and would not have to disclose the secret code in order to permit guests to conveniently enter the house. Also shown in FIG. 24 are screws 392, which function to retain spring 386. The battery power supply 366 rests on two members or shoulders 394, 394. Battery connector 398 is also shown in FIGS. 26 and 28. Inside wire harness 400 and switch bracket 402 are fastened to the housing with screw 403, as shown in FIGS. 26 and 28. Link cover 408 is fastened by three screws 410, as shown in FIG. 26. Spring or lock washers 412 and 414 contribute to retaining links 338 and 346 in proper position.

Figure 31:
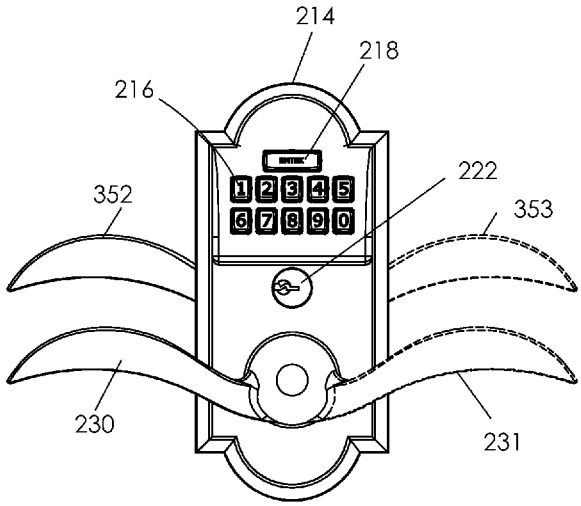
FIG. 31 is a front view of the FIG. 12 embodiment, as installed on a door; and, FIG. 32 is an alternate, close-up view of part of the interior or inner sub-assembly of the FIG. 12 embodiment showing a gate pass-through thumb push actuator mechanism.

Referring to FIGS. 24, 29, 30 and 31, outer lever 230 and inner lever 352 are shown in their home or resting positions. As is common in this field and as will be appreciated by those skilled in this art, the locksets are made with the capability to be installed with either a right-hand or left-hand orientation, depending on which side of the door the lockset is to be installed. Latch assembly 206 includes latch bolt 420 extending through a hole or bore in latch face plate 422, which is fastened to door 208 with screws 416, 418. Passage thumb turn 382 extends inwardly from the inside cover plate. As shown in FIG. 31, cylinder 222 is positioned below the 2×5 keypad grid having, preferably, two rows and five columns of digits for entry of codes into the electronic control system, and a rectangular key or button 218 preferably bears a product source identifier or can be utilized for a function. For example, this button could provide a means for turning on a back-light for the keys in the keypad during darkness or low light conditions, or for signaling functions. In this instance the button could be used to indicate entry of an incorrect code, entry of a correct code, or to activate a programming mode.

Figure 32:
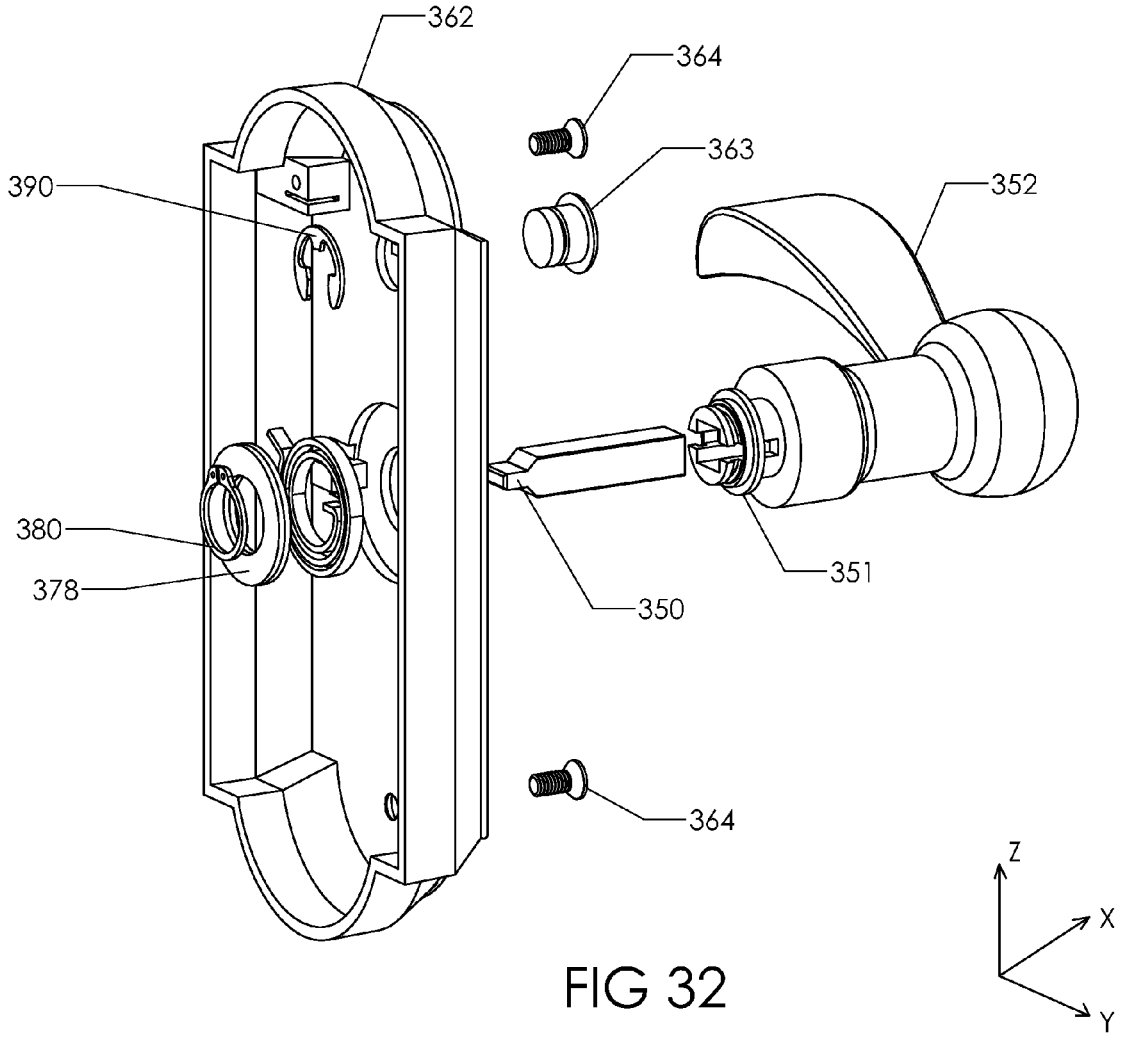

Referring to FIG. 32 the gate pass-through embodiment and capability will be described. The gate function defeats the pass-though mode or function, and is intended to be used in situations where a parent does not want a child to be able to permit a pass through, such as allowing friends to enter the house or swimming pool area without adult knowledge or control. FIG. 32 shows the inner escutcheon plate 362 with a plug 363 in place of thumb turn 382, as shown for example in FIG. 24. The "at-rest" or non-engaged condition of the gate function is such that the clutch is not and cannot be engaged from the inside. Thus, the only way to engage the clutch is by proper entry of a code.

As is apparent from the above description the linkage mechanism provides proper timing and synchronization of motion among the three rotational axes, because all of the moving parts are mechanically jointed. These linkages provide benefits of relatively few moving parts because of the direct linkage between axes, and of a full-time mechanical joint. The close interface clearances allow for smooth transmission of motion.

The locksets described above are preferably provided in modules, all of which are preferably pre-assembled. It is further preferred that each of the major components has a unique orientation that prevents any mistake from occurring during assembly of the modules. During installation of the lock in a door, the inside and outside modules must be placed in a single, predetermined position or orientation with respect to each other in order to line up together and cooperated with each other. Because of this preferred feature, untrained users or customers are able to install it without difficulty.

Although specific embodiments of the invention have been described, various modifications, alterations, alternative constructions, and equivalents are also encompassed within the scope of the invention.

The specification and drawings are, accordingly, to be regarded in an illustrative rather than a restrictive sense. It will, however, be evident that additions, subtractions, deletions, and other modifications and changes may be made thereunto without departing from the broader spirit and scope of the invention as set forth in the claims.

What is claimed is:

1. A lockset for use with a door comprising:

an electronic keypad positioned on a keypad housing and adapted to control a clutch sub-assembly;

said electronic keypad including a housing adapted to be positioned on an exterior side of said door and over a single, standard 2 and ⅛ inch door preparation bore;

an exterior latch actuating mechanism positioned in said keypad housing and having a first axis of rotation;

an interior latch actuating mechanism adapted to be positioned on an interior side of said door and adjacent said bore;

said clutch sub-assembly adapted for operating through said bore, adapted for coupling said exterior latch actuating mechanism to said interior latch actuating mechanism when said clutch sub-assembly is engaged and adapted for uncoupling said exterior latch actuating mechanism from said interior latch actuating mechanism when said clutch sub-assembly is disengaged;

said clutch sub-assembly comprising:

an exterior side mechanism, an interior side mechanism and a clutch axle engagable with said exterior side mechanism and engagable with said interior side mechanism;

said exterior side mechanism comprising;

a motor having an axle, a worm gear positioned at a first end of said axle, and said axle extending along a first axis and rotatable about said first axis;

a spring actuator having a first, anchor end, a second, clutch engaging end and a middle region engaged by said worm gear; and, a clutch actuator engaged by said clutch engaging end of said spring actuator and said clutch actuator adapted to reciprocate;

(i) in response to rotation of said worm gear; and, (ii) along a second axis, that is parallel to said first, axis;

said clutch axle extending through said door preparation bore along said second axis and engaging with said interior side mechanism upon engagement of said clutch sub-assembly;

said interior side mechanism operatively connected to a latch;

said latch positioned in said door and adapted to reciprocate through a standard 1-inch or ⅞ door preparation bore in response to rotation of said exterior latch actuating mechanism when said electronic keypad causes said clutch sub-assembly to be engaged.

2. The lockset of claim 1 wherein said exterior latch actuating mechanism comprises a gear train.

3. The lockset of claim 1 wherein said interior latch actuating mechanism comprises a gear train.

4. The lockset of claim 1 further comprising a mechanical override mechanism operable to override said clutch sub-assembly and to permit reciprocation of said latch independent of operation of said electronic keypad.

5. The lockset of claim 4 wherein said mechanical override mechanism is operable through said single, standard 2 and ⅛ inch door preparation bore.

6. The lockset of claim 1 wherein said exterior latch actuating mechanism comprises a thumb turn and said latch is a dead bolt.

7. The door keypad lockset of claim 1 whereby said motor is a DC motor, rotation of said axle of said motor in a first direction causes said clutch sub-assembly to disengage.

8. A door keypad lockset having a dead bolt comprising:

an electronic keypad positioned on a first side of said door and operable to control a clutch mechanism;

an exterior gear train positioned on said first side of said door;

an interior gear train positioned on a second side of said door; and, said clutch mechanism responsive to said electronic keypad adapted for coupling said exterior gear train to said interior gear train when said clutch mechanism is engaged and for uncoupling said exterior gear train from said interior gear train when said clutch mechanism is disengaged;

an exterior thumb turn mechanically coupled to said clutch mechanism such that when said clutch mechanism is engaged rotation of said external thumb turn will cause said dead bolt to be withdrawn to permit opening of said door; and, said keypad lockset adapted to operate through a single, standard 2 and ⅛ inch door preparation hole.

9. The door keypad lockset of claim 8 further comprising a mechanical override mechanism operable to override said clutch mechanism and to permit unlocking of said door independent of operation of said electronic keypad.

10. The door keypad lockset of claim 9 wherein said mechanical override mechanism comprises a cylinder sub-assembly having a spindle coupled to said dead bolt.

11. The door keypad lockset of claim 10 wherein said mechanical override mechanism is operable to override said clutch mechanism and to permit unlocking of said door independent of operation of said electronic keypad.

12. The door keypad lockset of claim 10 wherein said mechanical override mechanism comprises a cylinder sub-assembly with a spindle extending in a direction through said door preparation hole and is operable to override said clutch mechanism to permit unlocking of said door independent of operation of said electronic keypad.

* * * * *